US011795791B2

(12) United States Patent
Eitschberger et al.

(10) Patent No.: US 11,795,791 B2
(45) **Date of Patent: *Oct. 24, 2023**

(54) PERFORATING GUN ASSEMBLY WITH PERFORMANCE OPTIMIZED SHAPED CHARGE LOAD

(71) Applicant: DynaEnergetics Europe GmbH, Troisdorf (DE)

(72) Inventors: Christian Eitschberger, Munich (DE); Liam McNelis, Bonn (DE); Thilo Scharf, Donegal (IE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/896,172

(22) Filed: Aug. 26, 2022

(65) Prior Publication Data

US 2022/0403718 A1 Dec. 22, 2022

Related U.S. Application Data

(63) Continuation of application No. 17/383,816, filed on Jul. 23, 2021, now Pat. No. 11,499,401.
(Continued)

(51) Int. Cl.
*E21B 43/117* (2006.01)
*E21B 43/26* (2006.01)
*E21B 43/1185* (2006.01)

(52) U.S. Cl.
CPC ..... *E21B 43/117* (2013.01); *E21B 43/1185* (2013.01); *E21B 43/26* (2013.01)

(58) Field of Classification Search
CPC ..... E21B 43/117; E21B 43/26; F42B 1/02; F42B 3/08
See application file for complete search history.

(56) References Cited

U.S. PATENT DOCUMENTS 2,216,359 A 10/1940 Spencer
2,418,486 A 4/1947 Smylie
(Continued)

FOREIGN PATENT DOCUMENTS

AU 741792 B2 12/2001
AU 2010217183 B2 6/2016
(Continued)

OTHER PUBLICATIONS

US 11,274,530 B2, 03/2022, Eitschberger et al. (withdrawn)
(Continued)

*Primary Examiner* — Jennifer H Gay
(74) *Attorney, Agent, or Firm* — Womble Bond Dickinson (US) LLP

(57) ABSTRACT

Disclosed embodiments may relate to perforating gun assemblies configured for use in unconventional wells, for example in rock formations with low permeability. In some embodiments, the perforating gun assembly may include a perforating gun housing and at least one shaped charge positioned in the perforating gun housing. The shaped charge and the perforating gun housing may be jointly configured to improve total target penetration in unconventional wells by 20-100%. Related method embodiments may be used to improve the performance of unconventional wells.

20 Claims, 12 Drawing Sheets

Related U.S. Application Data

(60) Provisional application No. 63/145,843, filed on Feb. 4, 2021.

(56) References Cited

U.S. PATENT DOCUMENTS 2,644,530 A 7/1953 Baker
2,799,343 A 7/1957 Conrad
2,821,136 A 1/1958 Castel
2,889,775 A 6/1959 Owen
3,013,491 A 12/1961 Poulter
3,019,731 A 2/1962 David et al.
3,128,702 A 4/1964 Christopher
3,208,378 A 9/1965 Boop
3,211,093 A 10/1965 Mccullough et al.
3,246,707 A 4/1966 Bell
3,264,986 A 8/1966 Mohaupt
3,303,884 A 2/1967 Medford
3,444,810 A 5/1969 Hakala
3,565,188 A 2/1971 Hakala
3,589,453 A 6/1971 Venghiattis
3,650,212 A 3/1972 Bauer
3,659,658 A 5/1972 Brieger
3,923,105 A 12/1975 Lands
4,034,673 A 7/1977 Schneider, Jr.
4,071,096 A 1/1978 Dines
4,109,576 A 8/1978 Eckels
4,140,188 A 2/1979 Vann
4,191,265 A 3/1980 Bosse-Platiere
4,193,460 A 3/1980 Gilbert
4,234,768 A 11/1980 Boop
4,312,273 A 1/1982 Camp
4,387,773 A 6/1983 McPhee
4,393,946 A 7/1983 Pottier et al.
4,479,556 A 10/1984 Stout et al.
4,491,185 A 1/1985 McClure
4,496,008 A 1/1985 Pottier et al.
4,519,313 A 5/1985 Leidel
4,534,423 A 8/1985 Regalbuto
4,598,775 A 7/1986 Vann et al.
4,609,057 A 9/1986 Walker et al.
4,635,734 A 1/1987 Donovan et al.
4,655,138 A 4/1987 Regalbuto et al.
4,657,089 A 4/1987 Stout
4,753,301 A 6/1988 Berry
4,817,531 A 4/1989 Walker et al.
4,829,901 A 5/1989 Yates, Jr.
4,832,134 A 5/1989 Gill
4,919,050 A 4/1990 Dobrinski et al.
5,040,619 A 8/1991 Jordan et al.
5,098,487 A 3/1992 Brauer et al.
5,155,293 A 10/1992 Barton
5,323,684 A 6/1994 Umphries
5,379,845 A 1/1995 Blount et al.
5,564,499 A * 10/1996 Willis ..... E21B 43/26 166/308.1
5,648,635 A 7/1997 Lussier et al.
5,673,760 A 10/1997 Brooks et al.
5,775,426 A 7/1998 Snider et al.
5,785,130 A 7/1998 Wesson et al.
5,816,343 A 10/1998 Markel et al.
5,837,925 A 11/1998 Nice
5,960,894 A 10/1999 Lilly et al.
6,014,933 A 1/2000 Umphries et al.
6,062,310 A 5/2000 Wesson et al.
6,378,438 B1 * 4/2002 Lussier ..... F42B 1/036 102/306
6,397,947 B1 6/2002 Behrmann et al.
6,439,121 B1 8/2002 Gillingham
6,520,258 B1 2/2003 Yang et al.
6,591,911 B1 7/2003 Markel et al.
6,595,290 B2 7/2003 George et al.
6,619,176 B2 9/2003 Renfro et al.
6,684,791 B1 2/2004 Barnhart
6,851,471 B2 2/2005 Barlow et al.
6,925,924 B2 8/2005 Baker et al.
6,942,033 B2 9/2005 Brooks et al.
7,347,279 B2 3/2008 Li et al.
7,762,331 B2 7/2010 Goodman et al.
7,762,351 B2 7/2010 Vidal
7,819,064 B2 10/2010 Saenger et al.
7,886,842 B2 2/2011 Howard et al.
8,181,718 B2 5/2012 Burleson et al.
8,186,259 B2 5/2012 Burleson et al.
8,240,251 B2 8/2012 Waddell et al.
8,327,746 B2 12/2012 Behrmann et al.
8,414,715 B2 4/2013 Altschuler et al.
8,443,886 B2 5/2013 Torres et al.
8,684,083 B2 4/2014 Torres et al.
8,726,995 B2 5/2014 Bell et al.
8,931,569 B2 1/2015 Fagley et al.
9,045,692 B2 6/2015 Lumley
9,145,763 B1 9/2015 Sites, Jr.
9,297,242 B2 3/2016 Zhang et al.
9,382,783 B2 7/2016 Langford et al.
9,382,784 B1 7/2016 Hardesty et al.
9,428,979 B2 8/2016 Bell et al.
9,441,438 B2 9/2016 Allison et al.
9,494,021 B2 11/2016 Parks et al.
9,581,422 B2 2/2017 Preiss et al.
9,605,937 B2 3/2017 Eitschberger et al.
9,677,363 B2 6/2017 Schacherer et al.
9,689,223 B2 6/2017 Schacherer et al.
9,702,680 B2 7/2017 Parks et al.
9,725,993 B1 * 8/2017 Yang ..... E21B 43/119
9,810,048 B2 11/2017 Balun
9,845,666 B2 12/2017 Hardesty et al.
9,921,038 B2 3/2018 Weinhold
10,000,994 B1 6/2018 Sites
10,047,591 B2 8/2018 Bell et al.
10,047,592 B2 8/2018 Burgos et al.
10,053,969 B2 8/2018 Castillo et al.
10,060,234 B2 8/2018 Robey et al.
10,151,180 B2 12/2018 Robey et al.
10,151,181 B2 12/2018 Lopez et al.
10,174,595 B2 1/2019 Knight et al.
10,184,327 B2 1/2019 Skyler
10,240,441 B2 3/2019 Geerts et al.
RE47,339 E 4/2019 Sites, Jr.
10,273,788 B2 4/2019 Bradley et al.
10,337,270 B2 7/2019 Carisella et al.
10,337,310 B2 7/2019 Bell et al.
10,422,195 B2 9/2019 LaGrange et al.
10,429,161 B2 10/2019 Parks et al.
10,458,213 B1 * 10/2019 Eitschberger ..... E21B 43/1185
10,472,938 B2 11/2019 Parks et al.
10,584,565 B2 3/2020 Golian et al.
10,597,987 B2 3/2020 Escudero et al.
10,598,002 B2 3/2020 Sites
10,746,003 B2 8/2020 Yang et al.
10,767,430 B2 9/2020 Covalt et al.
10,830,566 B2 11/2020 Maxted et al.
10,858,920 B2 12/2020 Wells
10,914,144 B2 2/2021 Hardesty et al.
10,982,513 B2 4/2021 Gupta et al.
11,009,330 B2 5/2021 Saltarelli et al.
D921,858 S 6/2021 Eitschberger et al.
11,053,782 B2 * 7/2021 Loehken ..... E21B 43/117
11,078,762 B2 8/2021 Mauldin et al.
11,125,056 B2 9/2021 Parks et al.
11,215,041 B2 1/2022 Knight et al.
11,236,591 B2 2/2022 Knight et al.
11,299,967 B2 4/2022 Bradley et al.
11,313,653 B2 4/2022 Kash et al.
11,339,632 B2 5/2022 Eitschberger et al.
11,391,126 B2 7/2022 Dyess et al.
11,428,081 B2 8/2022 Bradley et al.
11,448,043 B2 9/2022 Bradley et al.
11,448,044 B2 9/2022 Dyess et al.
11,499,401 B2 * 11/2022 Eitschberger ..... E21B 43/117
11,525,344 B2 12/2022 Eitschberger et al.
2002/0017214 A1 2/2002 Jacoby et al.
2002/0185275 A1 12/2002 Yang et al.
2002/0189482 A1 12/2002 Kneisl et al.

(56) References Cited

U.S. PATENT DOCUMENTS

2003/0098158 A1 5/2003 George et al.
2004/0216633 A1 11/2004 Kash
2004/0216866 A1 11/2004 Barlow et al.
2004/0216868 A1 11/2004 Owen
2005/0115441 A1 6/2005 Mauldin
2005/0139352 A1 6/2005 Mauldin
2005/0173118 A1 8/2005 Li et al.
2005/0194146 A1 9/2005 Barker et al.
2005/0230099 A1 10/2005 Thomson et al.
2006/0075889 A1 4/2006 Walker
2007/0084336 A1 4/2007 Neves
2007/0119327 A1 5/2007 Myers et al.
2007/0158071 A1 7/2007 Mooney, Jr. et al.
2007/0158109 A1 7/2007 Zazovsky et al.
2008/0073081 A1 3/2008 Frazier et al.
2008/0121095 A1 5/2008 Han et al.
2009/0151588 A1 6/2009 Burleson et al.
2010/0089643 A1 4/2010 Vidal
2010/0132946 A1* 6/2010 Bell ..... E21B 43/26 166/298
2010/0230163 A1 9/2010 Hales et al.
2010/0252323 A1 10/2010 Goodman et al.
2010/0300750 A1 12/2010 Hales et al.
2011/0024117 A1 2/2011 Cardenas et al.
2011/0056362 A1* 3/2011 Yang ..... E21B 43/117 102/307
2011/0094406 A1 4/2011 Marya et al.
2012/0247769 A1 10/2012 Schacherer et al.
2012/0247771 A1 10/2012 Black et al.
2013/0118342 A1 5/2013 Tassaroli
2013/0220614 A1 8/2013 Torres et al.
2014/0008071 A1 1/2014 Patterson et al.
2014/0020896 A1 1/2014 Al-Gouhi
2014/0144702 A1 5/2014 Walker
2014/0238678 A1 8/2014 Arrell, Jr. et al.
2014/0251612 A1 9/2014 Powers
2015/0226043 A1 8/2015 Hardesty et al.
2015/0226044 A1 8/2015 Ursi et al.
2015/0285019 A1 10/2015 Wood et al.
2015/0376991 A1 12/2015 Mcnelis et al.
2016/0160568 A1* 6/2016 Randall ..... E21B 43/26 175/26
2016/0168961 A1 6/2016 Parks et al.
2016/0208587 A1 7/2016 Hardesty et al.
2017/0028437 A1 2/2017 Holly et al.
2017/0051586 A1 2/2017 Wells et al.
2017/0058649 A1 3/2017 Geerts et al.
2017/0145798 A1 5/2017 Robey et al.
2017/0158952 A1* 6/2017 Nguyen ..... C09K 8/685
2017/0167233 A1 6/2017 Sampson et al.
2017/0175498 A1 6/2017 Segura
2017/0199015 A1 7/2017 Collins et al.
2017/0241244 A1 8/2017 Barker et al.
2017/0276465 A1 9/2017 Parks et al.
2018/0030334 A1 2/2018 Collier et al.
2018/0087353 A1 3/2018 Skyler
2018/0106136 A1* 4/2018 Yang ..... E21B 43/117
2018/0202789 A1 7/2018 Parks et al.
2018/0202790 A1 7/2018 Parks et al.
2018/0209250 A1 7/2018 Daly et al.
2018/0209251 A1 7/2018 Robey et al.
2018/0216446 A1 8/2018 Allison
2018/0274342 A1 9/2018 Sites
2018/0372460 A1* 12/2018 Loehken ..... F42B 1/032
2019/0040722 A1 2/2019 Yang et al.
2019/0113315 A1* 4/2019 Dai ..... F42B 1/028
2019/0128095 A1* 5/2019 Hess ..... E21B 43/045
2019/0162055 A1 5/2019 Collins et al.
2019/0186241 A1 6/2019 Yang et al.
2019/0219375 A1 7/2019 Parks et al.
2019/0284889 A1 9/2019 LaGrange et al.
2019/0309606 A1 10/2019 Loehken et al.
2019/0330961 A1 10/2019 Knight et al.
2019/0353013 A1 11/2019 Sokolove et al.
2019/0368318 A1* 12/2019 Loehken ..... E21B 43/117
2019/0368321 A1 12/2019 Eitschberger et al.
2020/0018139 A1 1/2020 Eitschberger et al.
2020/0032626 A1 1/2020 Parks et al.
2020/0124584 A1* 4/2020 Morgan ..... G01N 33/24
2020/0157924 A1 5/2020 Melhus et al.
2020/0232300 A1* 7/2020 Hess ..... E21B 23/06
2020/0284126 A1 9/2020 Mauldin et al.
2021/0048284 A1 2/2021 Maxted et al.
2021/0172298 A1 6/2021 Knight et al.
2021/0238966 A1 8/2021 Preiss et al.
2021/0277752 A1 9/2021 Eitschberger
2021/0293121 A1 9/2021 Loehken et al.
2021/0317728 A1 10/2021 Preiss et al.
2021/0340844 A1 11/2021 Eitschberger et al.
2021/0340847 A1 11/2021 Davis et al.
2021/0348485 A1 11/2021 Mauldin et al.
2021/0381348 A1 12/2021 Wuensche et al.
2022/0074289 A1 3/2022 Cardenas et al.
2022/0154560 A1 5/2022 Eitschberger et al.
2022/0178230 A1 6/2022 Eitschberger et al.
2022/0243567 A1 8/2022 Eitschberger et al.
2022/0372851 A1 11/2022 Preiss et al.
2022/0403718 A1* 12/2022 Eitschberger ..... E21B 43/26
2023/0016759 A1 1/2023 Eitschberger et al.

FOREIGN PATENT DOCUMENTS

CA 2196385 A1 7/1998
CA 2821506 A1 1/2015
CA 2824838 A1 2/2015
CA 3101558 A1 12/2019
CA 2821506 C 3/2020
CA 3053174 C 1/2021
CN 2648065 10/2004
CN 101178005 B 10/2010
CN 202165062 U 3/2012
CN 202810806 U 3/2013
CN 104278976 A 1/2015
CN 104989335 A 10/2015
CN 205805521 U 12/2016
CN 104314529 B 1/2017
CN 205895214 U 1/2017
CN 209195375 U 8/2019
CN 213297926 U 5/2021
CN 113646505 A 11/2021
DE 1110108 B 7/1961
EP 0160449 A1 11/1985
EP 132330 B1 9/1988
EP 0216527 B1 11/1990
EP 1345003 A2 9/2003
EP 2282003 A2 2/2011
EP 3277913 A1 2/2018
EP 3239648 B1 9/2018
EP 3568664 A1 11/2019
EP 3478928 B1 6/2021
GB 2548101 A 9/2017
GB 2562179 B 11/2018
RU 7852 U1 10/1998
RU 2542024 C1 2/2015
RU 2579307 C1 4/2016
WO 2001096807 A2 12/2001
WO 2008098047 A2 8/2008
WO 2009117548 A1 9/2009
WO 2010104634 A3 11/2010
WO 2011160099 A1 12/2011
WO 2014179689 A1 11/2014
WO 2015006869 A1 1/2015
WO 2015102620 A1 7/2015
WO 2015179713 A1 11/2015
WO 2016046521 A1 3/2016
WO 2017062444 A1 4/2017
WO 2018009223 A1 1/2018
WO 2018026952 A1 2/2018
WO 2018057934 A1 3/2018
WO 2018057949 A1 3/2018
WO 2018231847 A1 12/2018
WO 2019071027 A1 4/2019
WO 2020154061 A1 7/2020

(56) References Cited

FOREIGN PATENT DOCUMENTS

| | | | |
|---|---|---|---|
| WO | 2020232242 | A1 | 11/2020 |
| WO | 2021116338 | A1 | 6/2021 |
| WO | 2021119370 | A1 | 6/2021 |

OTHER PUBLICATIONS

Core Lab, ZERO180™ Gun SystemAssembly and Arming Procedures—MAN-Z180-000 (RO7), Dec. 4, 2019, 33 pgs., https://www.corelab.com/owen/CMS/docs/Manuals/gunsys/zero180/MAN-Z180-000.pdf.
G & H Diversified Manufacturing; Yellow Jacket Oil Tools Orienting Sub; Dec. 18, 2022; 6 pages; https://ghdiv.com/orienting-sub/.
Halliburton, Halliburton Velocity™ Aligned Gun SysteM, Economic, Compact, and Versatile System for Orienting Perforations in Horizontal Wells, 2022, 2 pgs., www.halliburton.com.
United States Patent and Trademark Office; Non-Final Office Action for U.S. Appl. No. 17/383,816; dated Apr. 26, 2022; 11 pages.
United States Patent and Trademark Office; Non-Final Office Action for U.S. Appl. No. 17/383,816; dated Jan. 25, 2022; 23 pages.
Core Lab, ZERO180 Gun System Assembly and Arming Procedures MAN-Z180-000 (R10); Copyright 2015-2021 Owen Oil Tools; dated May 7, 2021; 38 pages.
SPEX Group; SPEX Bridge Plugs & Setting Tools; Jan. 12, 2017; 3 pages.
Amit Govil, Selective Perforation: a Game Changer in Perforating Technology—Case Study, presented at the 2012 European and West African Perforating Symposium, Schlumberger, Nov. 7-9, 2012, 14 pgs.
Austin Powder Company; A-140 F & Block, Detonator & Block Assembly; Jan. 5, 2017; 2 pgs .; https://www.austinpowder.com/wp-content/uploads/2019/01/OilStar_A140Fbk-2.pdf.
Core Lab, ZERO180™ Gun SystemAssembly and Arming Procedures, 2015, 33 pgs., https://www.corelab.com/owen/CMS/docs/Manuals/gunsys/zero180/MAN-Z180-000.pdf.
Corelab Owen Oil Tools; Expendable Perforating Guns Description; https://www.corelab.com/owen/cms/docs/Canada/10A_erhsc-01.0-c.pdf; 2008; 7 pages.
Dynaenergetics, DYNAselect Electronic Detonator 0015 SFDE RDX 1.4B, Product Information, Dec. 16, 2011, 1 pg.
Dynaenergetics, DYNAselect Electronic Detonator 0015 SFDE RDX 1.4S, Product Information, Dec. 16, 2011, 1 pg.
Dynaenergetics, Selective Perforating Switch, information downloaded from website, Jul. 3, 2013, 2 pages, http://www.dynaenergetics.com/.
Equip Outlet, Perforation Gun Pipe, Feb. 13, 2018, 7 pgs., http://www.equipoutlet.com/perforation-gun-pipe.html.
GeoDynamics; "Vapr"; promotional brochure; Oct. 1, 2019.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.
Hunting Energy Service, ControlFire RF Safe ControlFire® RF-Safe Manual, 33 pgs., Jul. 2016, http://www.hunting-intl.com/media/2667160/ControlFire%20RF_Assembly%20Gun%20Loading_Manual.pdf.
Hunting Energy Services Pte Ltd., "H-1 Perforating Gun System"; promotional brochure; Jun. 21, 2019.
Hunting Titan, H-1® Perforating Gun System, 2016, 2 pgs., http://www.hunting-intl.com/titan.
Hunting Titan, Inc., U.S. Appl. No. 62/621,999 titled Cluster Gun System, filed Jan. 25, 2018, which is a priority application of International App. No. PCT/US2019/015255 published as WO2019/148009, Aug. 1, 2019, 7 pages, WIPO.
Hunting Titan, Inc., U.S. Appl. No. 62/627,591 titled Cluster Gun System, filed Feb. 7, 2018, which is a priority application of International App. No. PCT/US2019/015255 published as WO2019/148009, Aug. 1, 2019, 7 pages, WIPO.
International Searching Authority, International Search Report and Written Opinion of International App. No. PCT/IB2019/000569, dated Oct. 9, 2019, 12 pages.
Jet Research Center, Velocity™ Perforating System Plug and Play Guns for Pumpdown Operation, Ivarado, Texas, Jul. 2019, 8 pgs., https://www.jetresearch.com/content/dam/jrc/Documents/Brochures/jrc-velocity-perforating-system.pdf.
OSO Perforating; "OsoLite"; promotional brochure; Jan. 2019.
Owen Oil Tools, Expendable Perforating Guns, Jul. 2008, 7 pgs., https://www.corelab.com/owen/cms/docs/Canada/10A_erhsc-01.0-c.pdf.
Thilo Scharf; "DynaEnergetics exhibition and product briefing"; pp. 5-6; presented at 2014 Offshore Technology Conference; May 2014.
United States Patent and Trademark Office; Advisory Action Before the Filing of an Appeal Brief for U.S. Appl. No. 17/004,966; dated May 21, 2021; 3 pages.
United States Patent and Trademark Office; Non-Final Office Action for U.S. Appl. No. 17/206,416; dated May 19, 2021; 10 pages.
WIPO, International Search Report for International Application No. PCT/CA2014/050673, dated Oct. 9, 2014, 3 pgs.
WIPO, Written Opinion of International Searching Authority for PCT Application No. PCT/CA2014/050673, dated Oct. 9, 2014, 4 pgs.
DynaEnergetics, No Debris Gun System (NDG), Hamburg, Germany, Feb. 6, 2008, 26 pgs.
Hunting Titan, Wireline Hardware, Logging Instruments EBFire, TCB Systems, Gun Systems, Oct. 15, 2015, V.9.1, 72 pgs., http://www.hunting-intl.com/media/1305595/hunting-titan-complete-v9-1.pdf.
Promperforator LLC, Perforating Systems Design and Manufacturing, 2014, 36 pgs., http://www.promperforator.ru/upload/file/katalog_eng_2014.pdf.
Schlumberger, OrientXact, 2013 2 pgs., https://www.slb.com/-/media/files/pe/product-sheet/orientxact-ps.ashx.
Schlumberger; Lina Pradilla, Wireline Efficiency in Unconventional Plays—the Argentinean Experience, including excerpted image from slide 13; dated 2013; 16 pages http://www.perforators.org/wp-content/uploads/2015/10/SLAP_47_Wireline_Efficiency_Unconventional_Plays.pdf.
United States Patent and Trademark Office; Decision Denying Institution of Post-Grant Review for PGR2021-00089; dated Dec. 14, 2021; 51 pages.
Albert, Larry et al.; New Perforating Switch Technology Advances Safety & Reliability for Horizontal Completions; Unconventional Resources Tech. Conference; Jul. 20-22, 2015; 7 pgs.
Brico Oil Tools; BT Tool Inspection, Care and Maintenance Guideline; Setting Tool Inspection Information Product Family No. 41-21; dated Jan. 11, 2014; https://www.bricooiltools.com/pdfs/Brico-Setting-Tool-Inspection-manual.pdf.
Dynaenergetics Europe GMBH; Exposed Gun Subs & Accessories; dated May 23, 2017; https://www.dynaenergetics.com/products/hardware-and-tcp/perforating-gun-systems/exposed-gun-subs-accessories.
Dynaenergetics Europe GMBH; Patent Owner's Preliminary Response for PGR No. 2021-00089; dated Sep. 16, 2021; 106 pages.
Geodynamics; Perforating Catalog; dated Mar. 5, 2020; 218 pages; https://www.perf.com/hubfs/PDF%20Files/PerforatingCatalog_03272020_SMS.pdf.
GR Energy Operating GP LLC, GR Energy Services Management, LP and GR Energy Services, LLC; GR Energy's Preliminary Invalidity Contentions for Civil Action No. 6:21-cv-00085-ADA; dated Aug. 30, 2021; 18 pages.
Harrison Jet Guns; Image of "xtra penetrator".
Hunting Titan; ControlFire; dated Jan. 5, 2017; 20 pages; http://www.hunting-intl.com/media/2666029/Hunting%20ControlFire%20Presentation_Public11.pdf.
Hunting; Payload: Preloaded Perforating Guns; 2 pages; http://www.hunting-intl.com/titan/perforating-guns/payload-preloaded-perforating-guns.
International Searching Authority, International Search Report for International App No. PCT/EP2020/063214, dated Jul. 29, 2020, 17 pages.

(56) References Cited

OTHER PUBLICATIONS

International Searching Authority; International Search Report and Written Opinion of the International Searching Authority for PCT/EP2021/057570; dated Sep. 13, 2021; 21 pages.
International Searching Authority; International Search Report and Written Opinion of the International Searching Authority for PCT/EP2021/058182; dated Aug. 26, 2021; 16 pages.
JPT; New Instrumented Docketing Gun System Maximizes Perforating Performance; dated Aug. 31, 2018 7 pages; https://jpt.spe.org/new-instrumented-docking-gun-system-maximizes-perforating-performance.
Logan, et al.; International Patent Application No. PCT/CA2013/050986; dated Dec. 18, 2013; 54 pages.
Oilfield Glossary; Definition of Perforating Gun; dated Feb. 26, 2013; 2 pages.
Rodgers, John; Declaration for Civil Action No. 3:20-CV-00376; dated Jul. 8, 2021; 32 pages.
Rodgers, John; Declaration for Civil Action No. 3:21-cv-00192-M; dated May 27, 2021; 42 pages.
Rodgers, John; Declaration for PGR No. 2021-00089; dated Sep. 16, 2021; 93 pages.
Rodgers, John; Declaration for PGR2021-00078; dated Aug. 19, 2021; 137 pages.
Salt, et al.; New Perforating Gun System Increases Saftey and Efficiency; Journal of Petroleum Technology; dated Apr. 1, 2016; Weatherford; https://jpt.spe.org/new-perforating-gun-system-increases-safety-and-efficiency; 11 pages.
Scharf, Thilo; Declaration for PGR No. 2021-00089; dated Sep. 16, 2021; 8 pages.
Schlumberger Technology Corporation; Defendant's Preliminary Invalidity Contentions; dated Aug. 19, 2021; 213 pages.
Schlumberger Technology Corporation; Exhibit A-01 to Defendant's Preliminary Invalidity Contentions Invalidity of U.S. Pat. No. 10,844,696 over WO20190148009; dated Aug. 19, 2021; 267 pages.
Schlumberger Technology Corporation; Exhibit A-02 to Defendant's Preliminary Invalidity Contentions Invalidity of U.S. Pat. No. 10,844,696 over U.S. Pat. No. 4,598,775; dated Aug. 19, 2021; 178 pages.
Schlumberger Technology Corporation; Exhibit A-03 to Defendant's Preliminary Invalidity Contentions Invalidity of U.S. Pat. No. 10,844,696 over U.S. Pat. No. 4,753,301; dated Aug. 19, 2021; 178 pages.
Schlumberger Technology Corporation; Exhibit A-04 to Defendant's Preliminary Invalidity Contentions Invalidity of U.S. Pat. No. 10,844,696 over U.S. Pat. No. 10,746,003; dated Aug. 19, 2021; 186 pages.
Schlumberger Technology Corporation; Exhibit A-05 to Defendant's Preliminary Invalidity Contentions Invalidity of U.S. Pat. No. 10,844,696 over WO2017/024266; dated Aug. 19, 2021; 247 pages.
Schlumberger Technology Corporation; Exhibit A-06 to Defendant's Preliminary Invalidity Contentions Invalidity of U.S. Pat. No. 10,844,696 over U.S. Pat. No. 4,479,556; dated Aug. 19, 2021; 250 pages.
Schlumberger Technology Corporation; Exhibit A-07 to Defendant's Preliminary Invalidity Contentions Invalidity of U.S. Pat. No. 10,844,696 over US2017/0145798; dated Aug. 19, 2021; 279 pages.
Science Direct; Perforating Gun Well-Bore Construction (Drilling and Completions); dated Jul. 20, 2021; 13 pages.
SWM International, LLC; Exhibit B: DynaEnergetics' Infringement of U.S. Pat. No. 11,078,762 for Civil Action No. 6:21-cv-00804; dated Aug. 3, 2021; 22 pages.
SWM International; Drawing of SafeJet System; dated Jul. 20, 2021; 1 page.
SWM International; Photographs of SafeJet System; dated Jul. 20, 2021; 9 pages.
United States Patent and Trademark Office; Non-Final Office Action for U.S. Appl. No. 17/004,966; dated Jul. 23, 2021; 22 pages.
United States Patent and Trademark Office; U.S. Provisional U.S. Appl. No. 62/736,298; dated Sep. 25, 2018; 120 pages.
DMC, Boom Times, Winter 2016 Brochure, DynaSlot System Successfully Deployed in a Variety of Applications Around the Globe, Issue 9, Sep. 16, 2016, 3 pgs.
Dynaenergetics, Dynaslot System 360° Certainty Well Abandonment, Produce Brochure, 6 pgs., https://www.dynaenergetics.com/en/products/hardware-and-tcp/perforating-gun-systems/dynaslot-gun-system.
International Searching Authority; International Preliminary Report on Patentability of the International Searching Authority for PCT/EP2022/051802; dated May 4, 2022; 11 pages.
Jilong, Han, et al., Application of W/Zr amorphous alloy for shaped charge liner, Materials Research Express, Oct. 11, 2019, 13 pages.
Naeem, Khalid et al., A Review of Shaped Charge Variables for its Optimum Performance, Engineering, Technology & Applied Science Research, 2019, 8 pages.
Schlumberger; Exposed Perforating Gun Systems Through-tubing capsule gun systems; https://www.slb.com/completions/well-completions/perforating/perforating-gun-systems/exposed#related-information; Oct. 26, 2020; 5 pages.
Schlumberger; PowerSprial Nova Extradeep spiral-phased capsule gun perforating system Press Release; dated Oct. 22, 2020; Retrieved from web on Jan. 18, 2021; https://www.slb.com/completions/well-completions/perforating/perforating-guns-and-charges/powerspiral-nova-capsule-gun-perforating-system; 2 pages.

* cited by examiner

PERFORATING GUN ASSEMBLY WITH PERFORMANCE OPTIMIZED SHAPED CHARGE LOAD

CROSS-REFERENCE TO RELATED APPLICATIONS

This application is a continuation of and claims priority to U.S. patent application Ser. No. 17/383,816 filed Jul. 23, 2021, which claims the benefit of U.S. Provisional Patent Application No. 63/145,843 filed Feb. 4, 2021. The entire contents of each of the applications listed above are incorporated herein by reference.

BACKGROUND OF THE DISCLOSURE

Hydraulic Fracturing (or, "fracking") is a commonly-used method for extracting oil and gas from geological formations (i.e., "hydrocarbon bearing formations") such as shale and tight-rock formations. Fracking typically involves drilling a wellbore, installing casings in the wellbore, perforating the wellbore, pumping high-pressure fracking fluids into the wellbore, and collecting the liberated hydrocarbons.

Unconventional oil and gas are hydrocarbons that are stored inside low-permeability rock with minimal oil-water or gas-water contact. As a result, they cannot be accessed using simple drilling and conventional perforation operations. The source rock for unconventional oil or gas usually include shale, coal-seam gas wells or also tight-gas sandstone formations. To efficiently obtain hydrocarbons from these hard-to-reach reservoirs, a combination of horizontal drilling with longer laterals and hydraulic fracturing is performed.

Plug and perf fracturing is the most common hydraulic fracturing method for recovering unconventional oil and gas. Plug and perf fracturing is a flexible, multi-stage operation done inside cased holes. The plug and perf operation typically involves pumping a frac plug and perforating gun assemblies into the wellbore from the surface, to a specific depth. After the plug is set, various clusters or areas of the casing pipe are perforated at the desired intervals, and the tool-string is removed from the well via a wireline cable.

The various perforations in the casing are required to provide access for the fluid to hydraulically fracture the rock formation at the desired locations downhole. The performance requirements for perforating equipment for unconventional well completion design are becoming more and more demanding, especially for longer lateral wells and deeper wells. For example, a specific concern is the more demanding requirements for specific, consistent, and large entry-hole diameters in the casing pipes. Additional concerns may include enabling a consistent and efficient hydraulic fracturing of the unconventional rock formation, increasing perforation tunnel volume in unconventional formations, and/or increasing formation contact in unconventional formations.

Accordingly, there is a need for an improved perforating gun assembly specifically for use unconventional oil and gas recovery operations. One solution for providing such improvements is the use of larger shaped charges with an improved performance regarding the tip fractures and tunnel geometry.

BRIEF DESCRIPTION OF THE EXEMPLARY EMBODIMENTS

According to an aspect, the exemplary embodiments include a selective perforating gun assembly. The selective perforating gun assembly includes a perforating gun housing, and at least one shaped charge positioned in the perforating gun housing. In some exemplary embodiments, each shaped charge of the at least one shaped charge includes an explosive load having a weight greater than 26 grams. In some embodiments, the perforating gun housing comprises a steel material having two or more of the following properties: minimum steel hardness of 250 HBW or 25 HRC (Rockwell), minimum yield strength of 650 MPa, minimum tensile strength of 900 MPa, and minimum impact strength of 70 Joule.

In another aspect, the exemplary embodiments include a perforating gun assembly including a perforating gun housing that is made of steel. A shaped charge is positioned in the perforating gun housing. In some exemplary embodiments, the shaped charge has an explosive load having a weight of at least 26 grams. In some embodiments, the perforating gun housing is configured so that, upon discharge of the at least one open-ended shaped charge, an outer diameter of the perforating gun housing expands to a swell diameter, and the swell diameter is no more than 3.78 inches. In some exemplary embodiments, the shaped charge may be configured to form a perforation tunnel in a low permeability rock formation having a permeability of 10 millidarcy or less.

In a further aspect, embodiments of the disclosure include a method of completing a wellbore. The method includes the step of positioning a perforating gun assembly in a section of a wellbore deviated from a vertical datum by at least 70 degrees or 80 degrees and having a permeability of less than 10 millidarcy. The perforating gun assembly includes a perforating gun housing, which may comprise a steel material having two or more of the following properties: minimum steel hardness of 250 HBW or 25 HRC(Rockwell), minimum yield strength of 650 MPa, minimum tensile strength of 900 MPa, and minimum impact strength of 70 Joule, and an open shaped charge positioned in the perforating gun housing. In some exemplary embodiments, the open shaped charge may have an explosive load with a weight of at least 26 grams. The open shaped charge is detonated to form a perforation in the wellbore. According to an aspect, the method further includes pumping a fracturing fluid through the perforation to fracture a hydrocarbon-bearing formation.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1A:
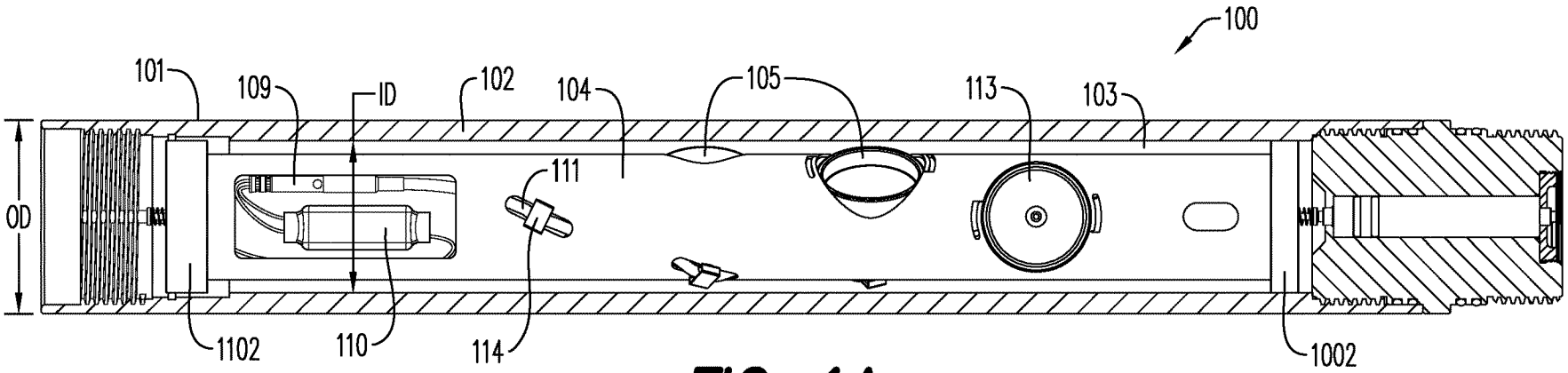
FIG. 1A is a partial cross-sectional view of a perforating gun assembly, according to an embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to aid in understanding the features of the exemplary embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various exemplary embodiments. Each example is provided by way of explanation and is not meant as a limitation and does not constitute a definition of all possible embodiments. It is understood that reference to a particular "exemplary embodiment" of, e.g., a structure, assembly, component, configuration, method, etc. includes exemplary embodiments of, e.g., the associated features, subcomponents, method steps, etc. forming a part of the "exemplary embodiment".

For purposes of this disclosure, the phrases "devices," "systems," and "methods" may be used either individually or in any combination referring without limitation to disclosed components, grouping, arrangements, steps, functions, or processes.

Figure 1B:
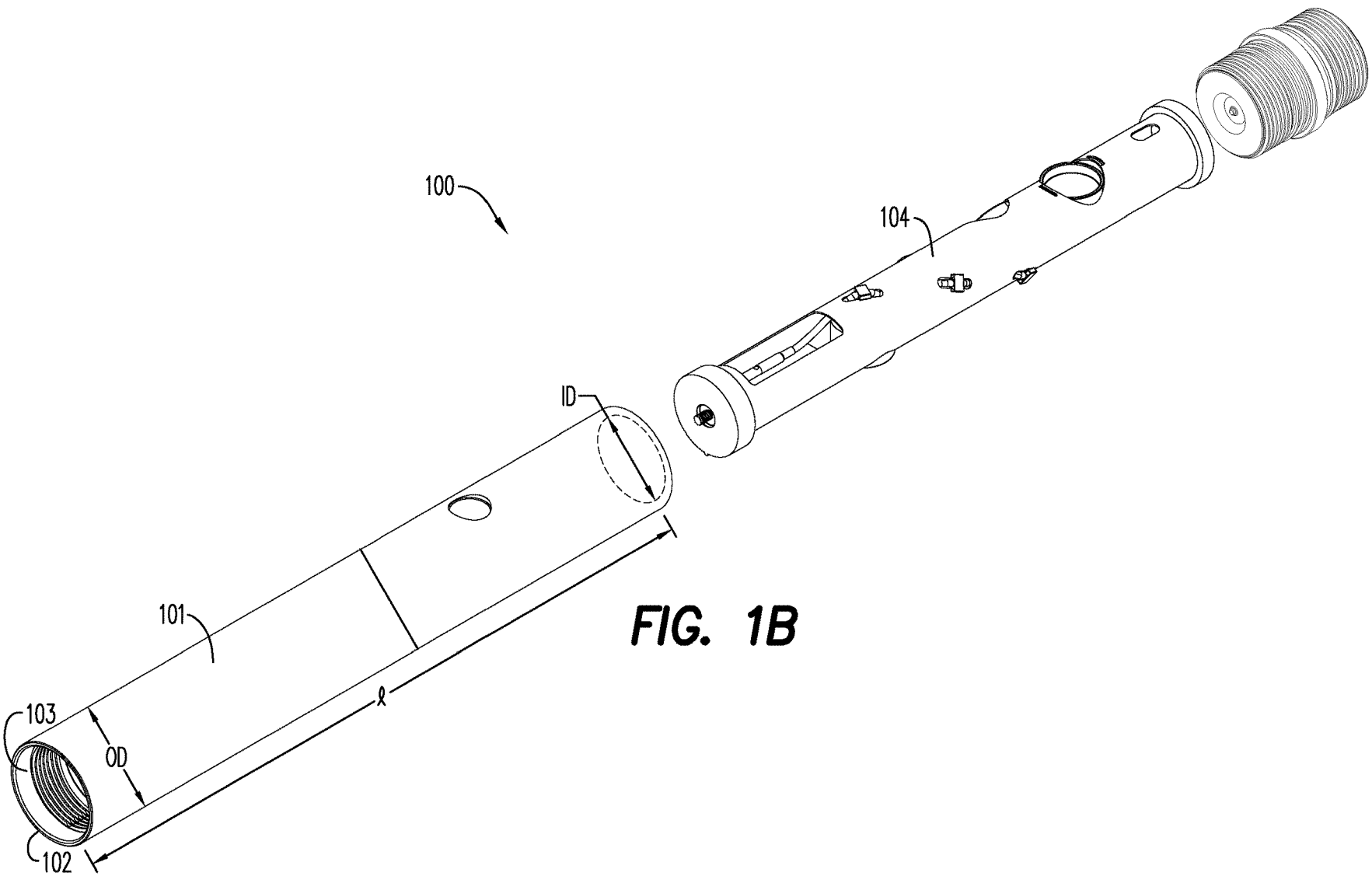
FIG. 1B is an exploded isometric view of the perforating gun assembly of FIG. 1A.

An exemplary embodiment will now be introduced according to FIGS. 1A-1B. The exemplary embodiment according to FIGS. 1A-1B is illustrative and not limiting, and exemplary features may be referenced throughout this disclosure.

As shown in FIG. 1A, some exemplary embodiments may relate to a perforating gun assembly 100, which may be used in an unconventional wellbore. The perforating gun assembly 100 includes a perforating gun housing or body 101 and at least one shaped charge 105 positioned in the perforating gun housing 101. In some exemplary embodiments, the perforating gun housing 101 may have an outer diameter of greater than 3.38 inches (e.g. 86 mm). According to an embodiment, the perforating gun housing 101 has an outer diameter of at least 3.42 inches (e.g. 87 mm). The perforating gun housing 101 may have an outer diameter of about 3.5 inches (e.g. 89 mm). Alternatively, the perforating gun housing 101 may have an outer diameter of 3.35-3.75 inches (85-95.3 mm) or 3.42-3.58 inches (e.g. 87-91 mm).

In some embodiments, the perforating gun housing 101 may be cylindrical (e.g. the exterior surface of the perforating gun housing 101 may form a cylinder with the outer diameter OD). In some embodiments, the perforating gun housing 101 may include a hollow interior 103 (e.g. a gun housing chamber or cavity, as shown in FIG. 1B for example), for example having an inner diameter ID of 2.625-2.9 inches (e.g. 66.7-73.7 mm), and the at least one shaped charge 105 may be configured to be disposed within the hollow interior 103. In some embodiments, the hollow interior 103 may be cylindrical in shape. In some embodiment, the perforating gun housing 101 may include a gun wall 102, which defines the perforating gun housing 101 and bounds the hollow interior 103 (e.g. the hollow interior 103 may be defined or bounded by an inner surface of the gun wall 102 of the perforating gun housing 101). In some embodiments, the gun wall 102 of the perforating gun housing 101 may have a wall thickness t of about 0.375 inches (e.g. 9.525 mm) (for example, +/−10%). In some embodiments, the gun wall 102 may have a thickness t of about 0.3375-0.4125 inches (e.g. 8.57-10.48 mm) or a thickness t of about 0.225-0.5625 inches (e.g. 5.72-14.29 mm), for example depending on the embodiment. In some embodiments, the perforating gun housing 101 may have a length l of at least about 8.5 inches (e.g. 216 mm).

In some embodiments, the perforating gun housing 101 may be formed from a steel material. The steel material may have one or more of the following properties: minimum steel hardness of 250 HBW or 25 HRC(Rockwell), a minimum yield strength of 650 MPa, and a minimum tensile strength of 900 MPa. According to an aspect, the steel material has a minimum impact strength of 70 Joule. In an example, the perforating gun housing 101 may be formed of a steel material having a minimum steel hardness of 250 HBW or 25 HRC(Rockwell), minimum yield strength of 650 MPa, a minimum tensile strength of 900 MPa, and a minimum impact strength of 70 Joule. In some embodiments, the steel material used to manufacture the perforating gun housing 101 may be formed from hot rolled steel pipes, cold drawn steel pipe, or solid steel bar stock, which is tempered and heat treated (e.g. water quenched).

In some embodiments, each of the at least one shaped charge 105 may be configured for use in unconventional wells. For example, the shaped charge may have an inner geometry and caliber which enables the reliable achievement of a large range of consistent entry-hole-diameters using an identical charge case for each shaped charge design.

In some embodiments, each shaped charge of the at least one shaped charge 105 may be configured to form a perforation tunnel with an entry hole diameter of about 0.30-0.85 inches in an adjacent portion of the steel casing (for example, a steel wellbore casing formed from 5½ inch P110 Grade steel with a weight density of 23 lbs/ft of casing pipe). According to an aspect, the entry hole diameter may be about 0.30-0.80 inches, alternatively 0.40-0.70 inches.

In some embodiments, the shaped charge 105 may be configured to form a perforation tunnel in a low permeability rock formation having a permeability of 10 millidarcy or less, or in some aspects, 1 millidarcy or less. Depending on the desired entry hole diameter for the particular application in which the perforating gun will be utilized, each shaped charge of the at least one shaped charge 105 may further include a shaped charge liner of a particular design. The hole-size and geometry of the perforation tunnel formed by the shaped charge 105 may enable consistent and efficient hydraulic fracturing of the rock formation, even if the rock formation has low permeability and/or forms an unconventional formation.

Figure 2B:
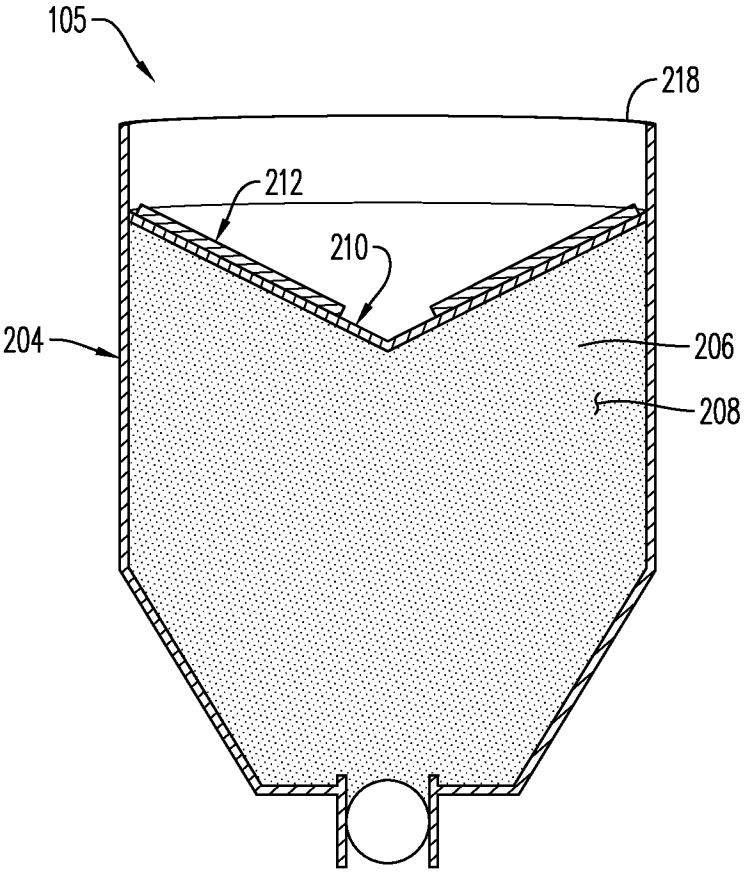
FIG. 2B is a cross-section view of the shaped charge of FIG. 2A.
Figure 2A:
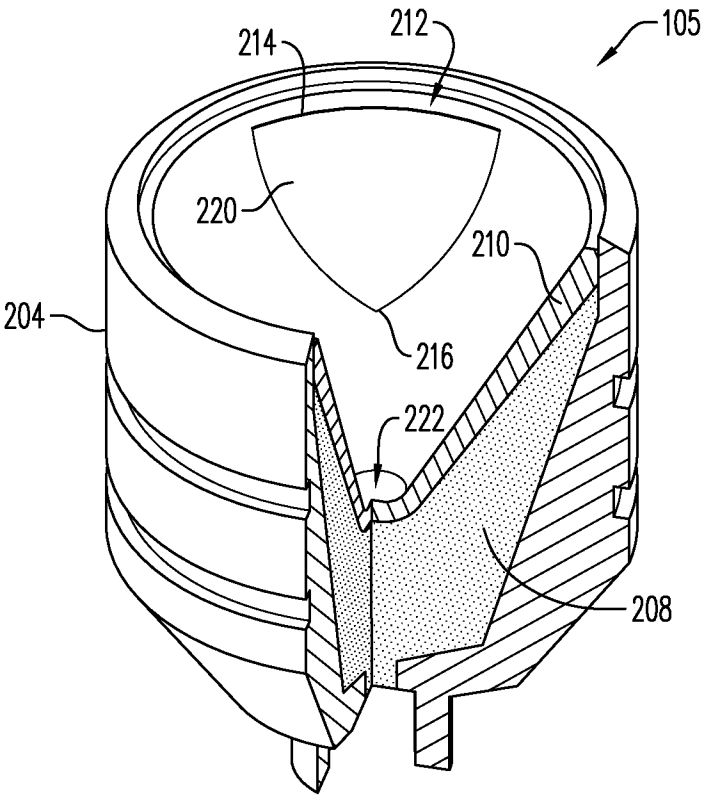
FIG. 2A is an isometric, partial cut-away view of an exemplary shaped charge for use with the perforating gun assembly of FIG. 1A, according to an embodiment.

In some embodiments, and as shown for example in FIGS. 2A-2B, each shaped charge 105 may include a shaped charge case 204 that forms a hollow cavity 206. FIG. 2A illustrates the shaped charge case 204 having a generally conical shaped, however, it is contemplated that the case 204 may be substantially rectangular in some embodiments (i.e., the shaped charge may be a slotted shaped charge). In some embodiments, each shaped charge of the at least one shaped charge 105 may include an explosive load 208, for example positioned in the cavity 206 of the shaped charge 105. The explosive load 208 has a weight greater than 26 grams. According to an aspect, the explosive load 208 has a weight that is greater than 28 grams. The explosive load 208 may have a weight of about 30 grams, 28 grams to 32 grams, or 28 grams to 35 grams. The explosive load 208 may include one or more explosive powders, including at least one of octahydro-1,3,5,7-tetranitro-1,3,5,7-tetrazocine/cyclotetramethylene-tetranitramine (HMX), cyclotrimethylenetrinitramine (RDX), pentaerythritol tetranitrate (PETN), hexanitrostibane (HNS), and 2,6-Bis(picrylamino)-3,5-dinitropyridine/picrylaminodinitropyridin (PYX). The explosive load 208 may include and triaminotrinitrobenzol (TATB). According to an aspect, the explosive load 208 includes at least one of hex HNS and diamino-3,5-dinitropyrazine-1-oxide (LLM-105). The explosive load may include a mixture of PYX and TATB.

In some embodiments, the explosive load 208 is disposed within the hollow cavity 206, and a liner 210 is disposed adjacent to the explosive load 208. The liner 210 may be configured to retain the explosive load 208 in the hollow cavity 206 of the shaped charge case 204. According to an aspect, a shaped charge inlay 212 is disposed on top of a portion of the liner 210 (e.g. such that at least a portion of the liner 210 is between the inlay 212 and the explosive load 208). The shaped charge inlay 212 may be disposed above the existing liner 210 in the shaped charge 105, to disrupt collapse of the existing liner 210 upon detonation of the shaped charge 105 and thereby change the geometry of a perforating jet and resulting perforation created by the shaped charge 105. The case 204 may be formed from machinable steel, aluminum, stainless-steel, copper, zinc, and the like. The liner 210 may be formed from a variety of various powdered metallic and non-metallic materials and/or powdered metal alloys, and binders. The shaped charge inlay 212 may be formed from a rigid material or semi-rigid material such as a plastic material or polymer such as polyamide, a metal, a combination of such materials, or other materials consistent with this disclosure. In some embodiments, the shaped charge inlay 212 may be formed from a rubber material.

In some embodiment, the shaped charge inlay 212 may be secured (e.g. by adhesive) to the liner 210, and may include an upper edge 214, and a distal edge 216 opposite the upper edge 214. The upper edge 214 may extend inwardly from an edge 218 of a shaped charge case 204 associated with a shaped charge 105. The shaped charge inlay 212 further may include a body 220 that extends between the upper and distal edges, and toward an apex 222 of the liner 210. According to an aspect, at least a portion of the shaped charge inlay 212 covers a portion of the liner 210 that is away from the apex 222 of the liner 210. In some embodiments, the shaped charge inlay 212 does not overlap the apex 222. The shaped charge inlay 212 may be configured to adapt shaped charges 105 so that the shaped charge 105 can be used to create atypical perforation hole geometries, regardless of the shape of the case of the shaped charge 105. The atypical hole geometries are different than the standard perforating hole geometry that would be formed in the absence of the shaped charge inlay 212. For example, each shaped charge 105 may be configured to form a perforating jet that creates an atypical perforation hole geometry in a target (e.g. the casing and/or rock formation of the well), which include constant open areas to flow in the target when the perforating gun is centralized or decentralized in a wellbore casing.

Figure 4:
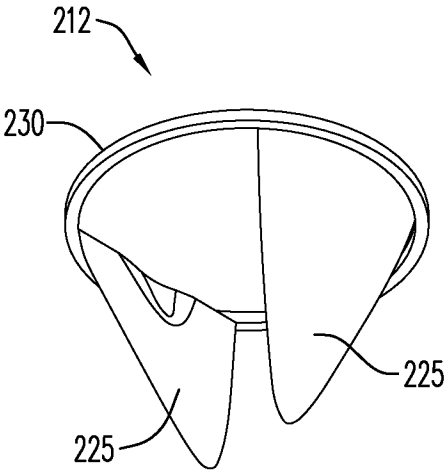
FIG. 4 is an isometric view of an exemplary shaped charge inlay, according to an embodiment.
Figure 3:
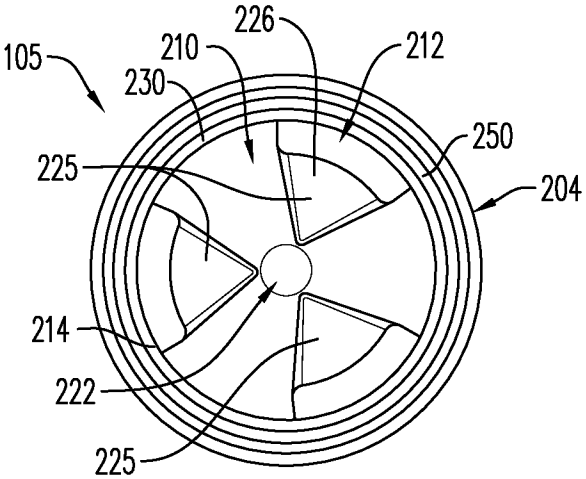
FIG. 3 is a top view of an exemplary shaped charge, according to an embodiment.

Some embodiments of the shaped charge inlay 212, for example as illustrated in FIG. 3, may include an upper edge 214, a continuous ring 230 formed at the upper edge 214, and a plurality of fingers 225 extending from the continuous ring 230. The fingers 225 may be arranged in a manner that forms an open apex 222 opposite the continuous ring 230. The shaped charge inlay 212 may be particularly suited for use with a liner 210 in a shaped charge 105 and is configured to transform a perforating jet to create atypical perforating hole geometries. According to an aspect, the atypical perforation hole geometries are based in part on the quantity (e.g. number) of the fingers 225. For example, FIG. 3 illustrates an inlay 212 having 3 fingers 225, while FIG. 4 illustrates an inlay 212 having only 2 fingers 225. The number of fingers 225 may include 3, 4, 5, 6, or more.

Figure 5B:
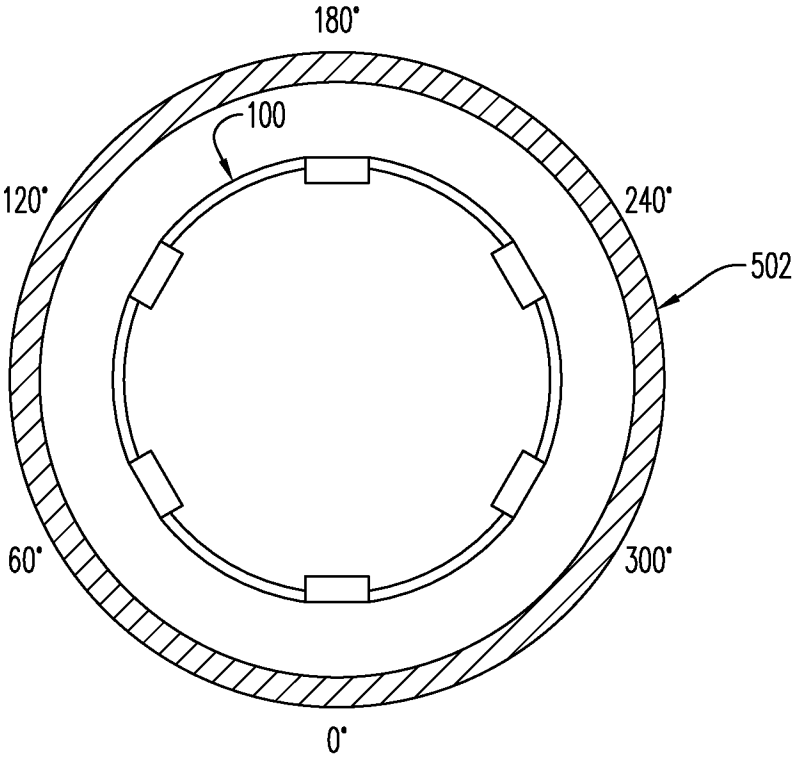
FIG. 5B is a schematic cross-section view of an exemplary perforating gun assembly disposed within a wellbore in a centralized configuration, according to an embodiment.
Figure 5A:
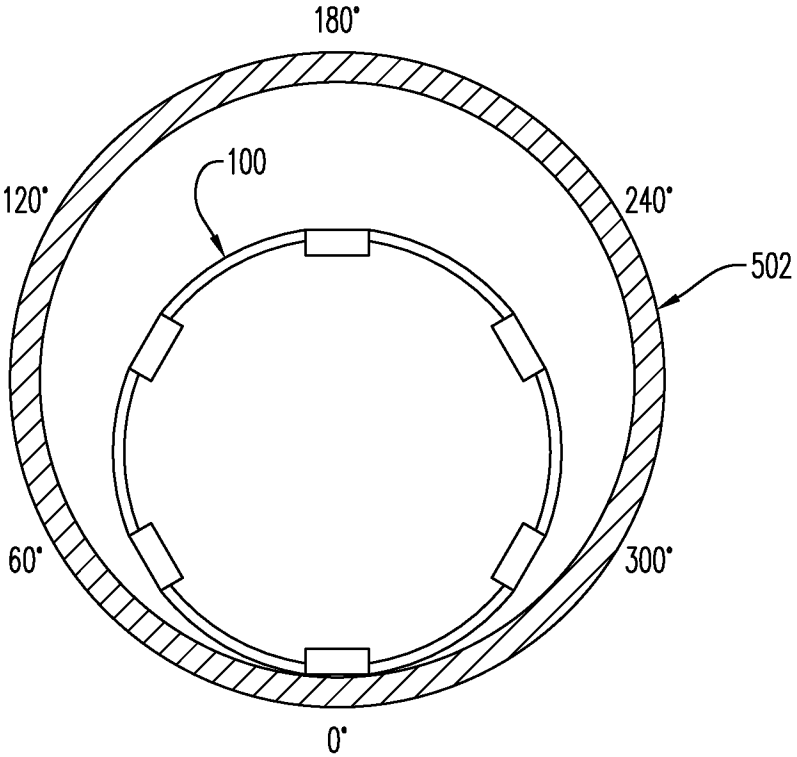
FIG. 5A is a schematic cross-section view of an exemplary perforating gun assembly disposed within a wellbore in a decentralized configuration, according to an embodiment.

FIGS. 5A-5B illustrate the perforating gun assembly 100 within an exemplary wellbore 502. FIG. 5A illustrates the perforating gun assembly 100 in a decentralized location, and FIG. 5B illustrates the perforating gun assembly 100 in a centralized location. In some embodiments where the perforating gun assembly includes two or more shaped charges 105, constant open areas/constant open areas to flow are created upon detonation of the two or more shaped charges 105. The constant open areas to flow are created when the perforating gun assembly 100 is centralized (FIG. 5B) or decentralized (FIG. 5A) in a wellbore 502 or wellbore casing. In addition, the constant open areas may be created when the target includes wellbore casings, cement, and/or a rock formation including sandstone, shales or carbonates. The open areas to flow of the perforation hole geometries may deviate or vary from each other. As used herein, the term "variation" means a change, diversion or difference in the size of the perforation holes formed in a target, even though the perforation holes are created by identical shaped charges 105. For example, when the shaped charges have a slotted/rectangular case, the area open to flow of the perforations may be measured with an image processing software or may be approximated using the following formula:

$$AOF=W\times H$$

wherein AOF is the area open to flow, W is the average width of the perforation, and H is the average height of the perforation. Alternatively, when the shaped charges have a conical case, the area open to flow of the perforations may be measured with an image processing software or may be approximated using the following formula:

$$AOF=\pi R^2$$

$$\text{or } AOF=\pi/4\times D2$$

where, D is the diameter of the perforated casing hole, and R is the radius.

According to an aspect, the at least one shaped charge 105 may include a first shaped charge and a second shaped charge. The variation between the open area to flow of the perforation hole geometry of the first shaped charge and the open area to flow of the perforation hole geometry of the second shaped charge may be less than 20%. In an embodiment, upon detonation of the first shaped charge and the second shaped charge, the open areas to flow of the atypical perforation hole geometries formed by the first and second shaped charges 105 has a variation that is less than 15%. According to an aspect, the variation between the open area to flow of the perforation hole geometries of the different shaped charges 105 may be less than 10%, that is, the open areas to flow are constant open areas to flow. According to an aspect the variation may be less than 7%. The shaped charges 105, in combination with the inlays produce constant open areas to flow having variations of less than 10% when the perforating gun assembly 100 is decentralized (FIG. 5A) and/or when the gun is centralized (FIG. 5B) in the wellbore 502. For example, if the perforating gun assembly 100 is decentralized in the wellbore 502 (such that the distance between the different shaped charges 105 and their adjacent portions of the cased wellbore 502 differs in length), regardless the different shaped charges 105 (which each are substantially identical) will form constant open areas with low variation.

Further details regarding shaped charges 105 (including inlays configured to produce constant open areas whether the perforating gun assembly 100 is centralized or decentralized in the wellbore) are described in U.S. Pat. No. 11,053,782, issued Jul. 6, 2021, which is hereby incorporated by reference in its entirety to the extent that it is consistent and/or compatible with this disclosure.

In some embodiments, see for example FIG. 1A, the at least one shaped charge 105 may include a plurality of shaped charges 105. For example, some embodiments of the perforating gun assembly 100 may include 3-4 shaped charges 105. In some embodiments, the plurality of shaped charges 105 may be oriented to fire outward at different radial locations around a circumference of the perforating gun housing 101 (e.g. to create perforation holes in a target, such as the casing of the wellbore into which the perforation gun assembly is disposed). In some embodiments, orientation of the shaped charge 105 may be by a shaped charge carrier disposed within the perforating gun housing 101, for example with the shaped charge carrier configured to orient the shaped charges 105. In some embodiments, as discussed above, each perforation hole of the perforation holes formed by firing of the perforating gun shaped charge(s) 105 may include an open area that is open to flow of wellbore fluid and has a size (e.g. diameter) that is substantially constant (e.g. consistent) between both centralized and decentralized conditions of the perforating gun housing 101 in a casing of the wellbore. For example, the variation amount of between centralized and decentralized usage may be 10% or less.

Figure 6A:
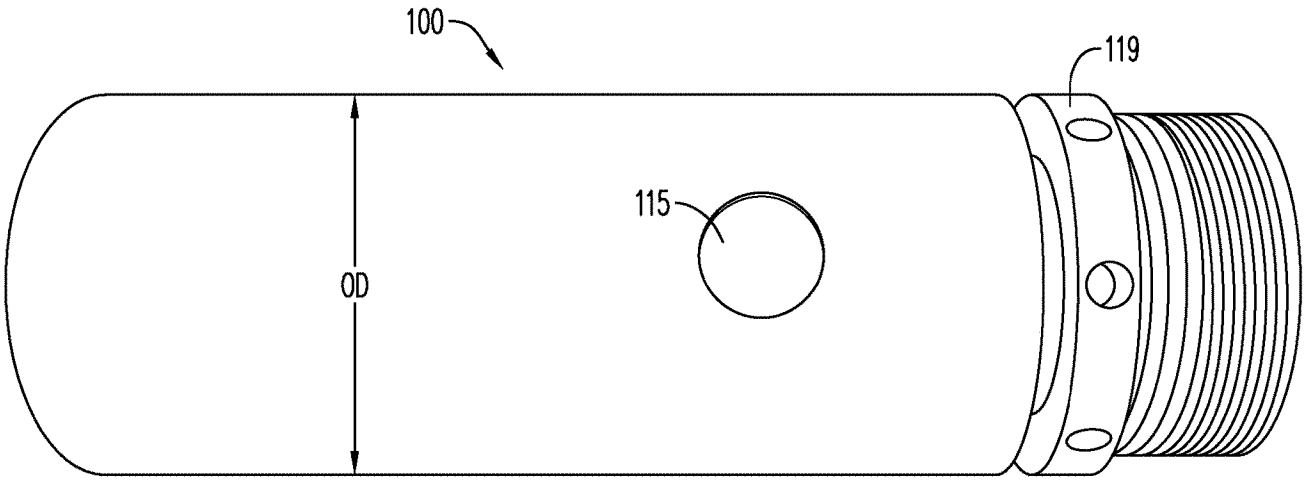
FIG. 6A is a side view of an exemplary perforating gun assembly before firing of a shaped charge, according to an embodiment.
Figure 6B:
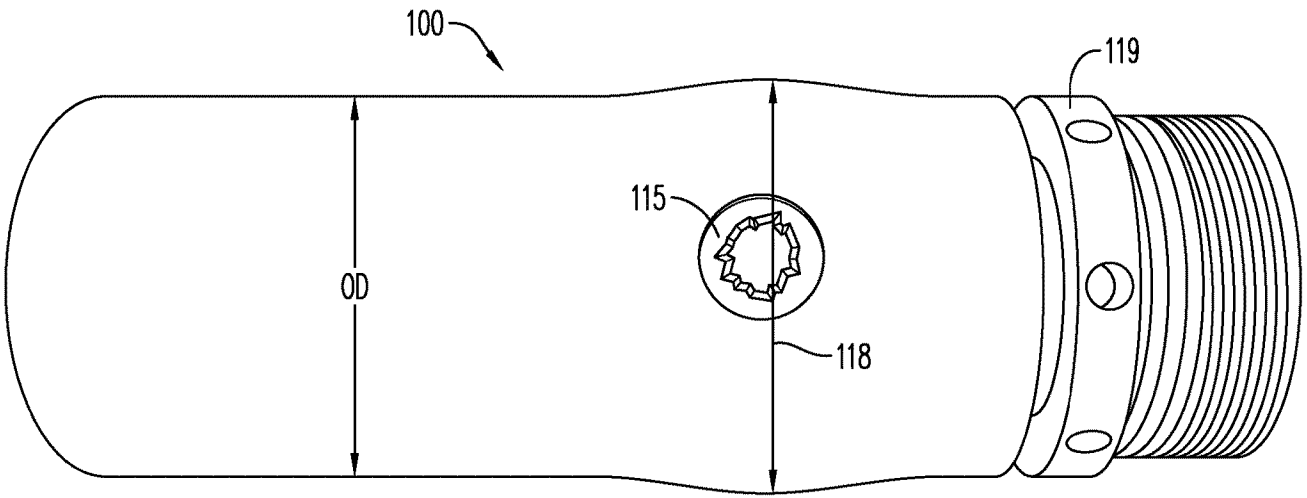
FIG. 6B is a side view of the perforating gun assembly of FIG. 6A after firing of the shaped charge, illustrating a gun swell.

The perforating gun assembly 100 may be configured so that, upon discharge of the at least one shaped charge 105, the perforating gun housing 101 has a swell diameter (e.g. outer swell diameter) 118. For example, upon discharge of the shaped charge 105, the outer diameter of the perforating gun housing 101 may expand/swell to a swell diameter 118 larger than the initial outer diameter (e.g. in proximity to the discharged shaped charge 105), and the swell diameter 118 may be 3.6-3.78 inches (e.g. 91-96 mm) or no larger than 3.78 inches (e.g. 96 mm). FIG. 6A illustrates an exemplary perforating gun housing 101 prior to firing of a shaped charge 105. FIG. 6B illustrates the perforating gun housing 101 with a swell diameter 118 after firing of the shaped charge 105 (e.g. through a scallop 115 in the gun wall of the perforating gun housing 101). After perforating, the perforating gun housing 101 may have a swell diameter 118 radially outward from the position of the shaped charge 105. The swell diameter 118 of the perforating gun housing 101 after discharge of the shaped charge 105 (e.g. perforation) is configured to be less than the wellbore diameter (e.g. no excess gun swell), allowing easy extraction of the perforating gun assembly 100 from the wellbore (e.g. the perforating gun assembly 100 is not stuck or wedged in the wellbore). In some embodiments, the inner diameter of the casing pipe for the wellbore (e.g. the wellbore diameter) may be 4 inches or more. In some examples, the casing pipe wall thickness may be about 8-12 mm.

In some embodiments, the perforating gun assembly 100 may include a shot density of at least 2 shots per foot (e.g. 2-6 shots per foot, 2-5 shots per foot, or 2-4 shots per foot). In an aspect, the perforating gun assembly 100 may include a shot density of at least 3 shots per foot (e.g. 3-6 shots per foot, 3-5 shots per foot, or 3-4 shots per foot). Other aspects of the perforating gun assembly 100 may include a shot density of at least 4 shots per foot (e.g. 4-6 shots per foot or 5-6 shots per foot). In some embodiments, the plurality of shaped charges 105 may all be substantially identical (e.g. in size, shape, and amount of explosive load). In some embodiments, for example with shot densities as described above, the perforation holes formed may all have constant open areas of flow (e.g. approximately the same flow rate).

Figure 15A:
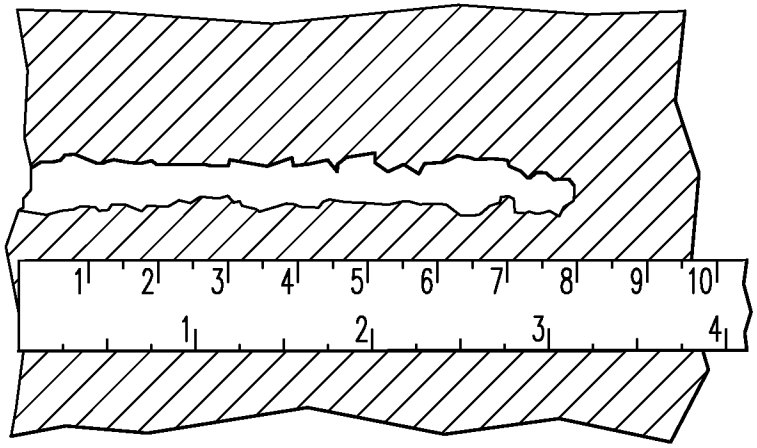
FIG. 15A illustrate a perforation formed using an exemplary conventional perforation gun assembly.
Figure 15B:
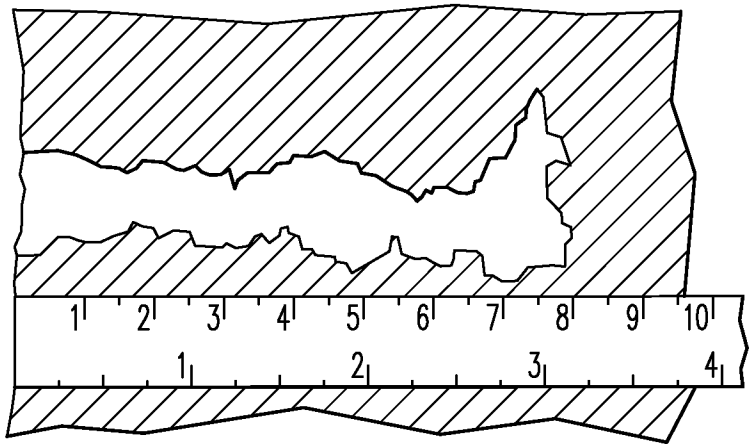
FIG. 15B illustrates a perforation tunnel formed using a perforating gun assembly according to disclosed embodiments.

In some embodiments, the perforation gun assembly may be configured so that the shaped charges 105 deliver 20-60% (e.g. about 30%) more explosive energy to the rock formation (e.g. for a shale formation), for example compared to a conventional 3⅛" sized perforating gun assembly with a 22.7 gram shaped charge. In some embodiments, the configuration of the perforating gun may provide significant fracturing performance improvement in unconventional wells (e.g. wells in low-porosity rock formations, for example with porosity of 10 milidarcy or less). For example, the perforating gun assembly 100 may be configured to provide increased perforation tunnel volume by 20-100% or more (e.g. about 75%) and/or provide increased formation contact (e.g. of internal area of the perforation tunnel including fractures) by 20-100% (e.g. about 40%) in a shale rock formation, for example compared to 3⅜" or 3⅛" sized perforating gun assemblies with a 22.7 gram shaped charge, particularly when the shale target has about 18,000 UCS, about 6500 psi confinement, and/or about 3000 psi or higher wellbore pressures. For example, see FIGS. 15A-15B. FIG. 15A illustrates an exemplary perforation tunnel formed by a conventional perforating gun assembly, such as DS Infinity FracTune DP40 by DynaEnergetics. FIG. 15B illustrates an exemplary perforation tunnel as formed by a perforating gun assembly as described herein (e.g. with a housing having an outer diameter of about 3.5 inches and the shaped charge having an explosive load with a weight of 28-35 grams). FIG. 15B has a much wider perforation tunnel, resulting in a more productive wellbore.

Figure 7:
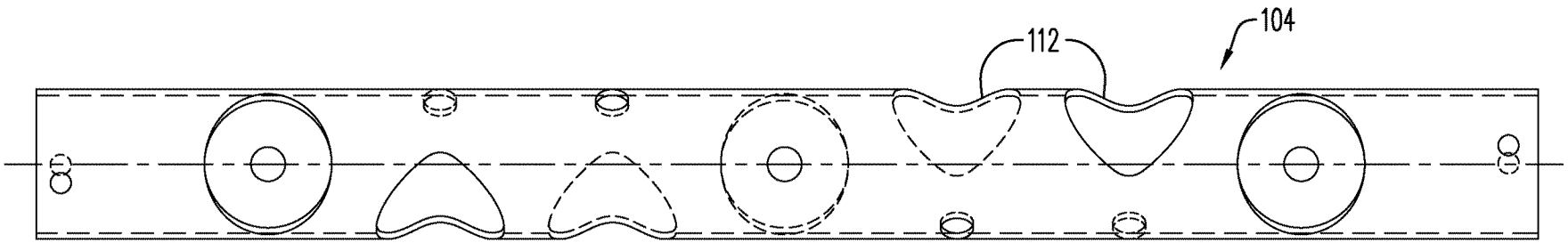
FIG. 7 is a side view of an exemplary shaped charge loading tube, according to an embodiment.
Figure 8:
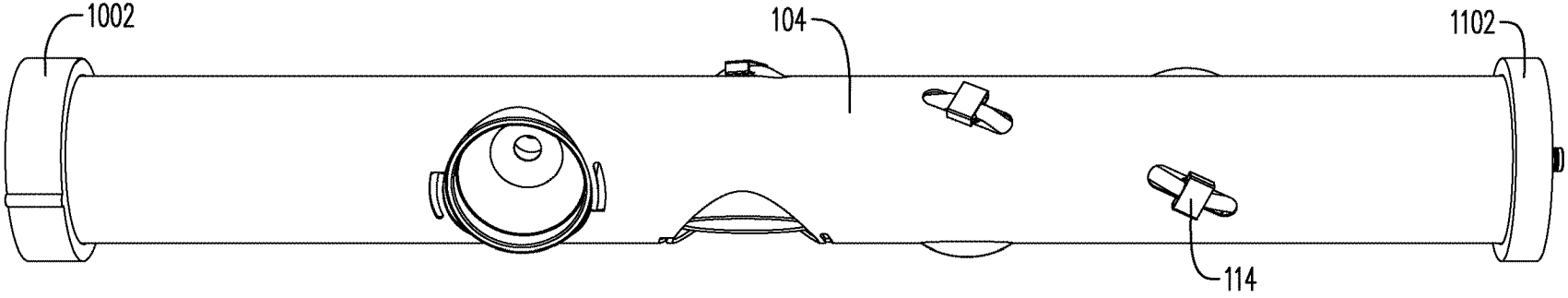
FIG. 8 is a side view of another exemplary shaped charge loading tube, according to an embodiment.
Figure 9:
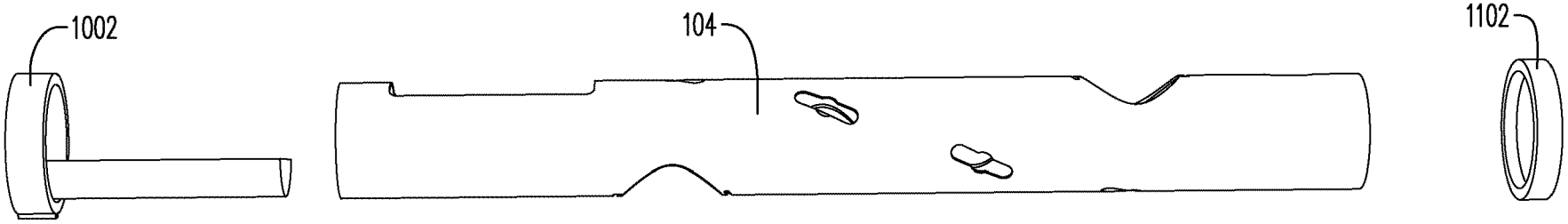
FIG. 9 is an exploded isometric view of the shaped charge loading tube of FIG. 8, according to an embodiment.

Some embodiments of the perforating gun assembly 100 may further include a shaped charge carrier, which may be positioned in the hollow interior 103 (e.g. gun housing chamber) of the perforating gun housing 101. The shaped charge carrier may be configured to hold the at least one shaped charge (e.g. directed outward). The shaped charge carrier may be configured to fit within the hollow interior 103 of the perforating gun housing 101. In some embodiments, the at least one shaped charge is positioned in the shaped charge carrier. FIGS. 7-9 illustrate exemplary embodiments of a shaped charge carrier.

With reference to FIGS. 1A and 7, the shaped charge carrier may be configured as a shaped charge tube loading tube 104. In some embodiments, the shaped charge loading tube 104 may be provided in the hollow interior 103 of the perforating gun housing 101 to house one or more shaped charges 105, a detonator 109, a switch 110, and/or detonating cord 111 within the hollow interior 103 of the perforating gun housing 101.

According to an aspect, the shaped charge loading tube 104 may include an opening or shaped charge receptacle 112 for receiving a shaped charge 105 therein, for example with one shaped charge receptacle 112 for each of the at least one shaped charges 105. A detonating cord opening may be radially disposed from the opening 112 to receive the detonating cord 111 and orient the detonating cord 111 along a length of the perforating gun housing 101. In some embodiments, the shaped charge loading tube 104 may include a single opening 112 and a single detonating cord opening. In other embodiments, the shaped charge loading tube 104 may include a plurality of openings 112. Each opening 112 may be sized and shaped to receive a shaped charge 105 within the loading tube 104 so that an open end 113 of the shaped charge 105 is oriented toward the nearest portion of the gun wall 102 for firing through. In some embodiment, each opening 112 of the plurality of openings 112 may be oriented in a spiral configuration (e.g. with phasing) along the length of the shaped charge loading tube 104 (see for example FIG. 1A). In an aspect and with reference to FIG. 7, two or more adjacent openings 112 in the shaped charge loading tube 104 may be longitudinally aligned (i.e., positioned along the same plane in the longitudinal direction of the shaped charge loading tube 104), so that the firing directions of the respective shaped charges 105 housed in each opening 112 are radially aligned. In some embodiments, the shaped charge loading tube 104 may include two sets of aligned adjacent openings 112 (e.g. each set may have two or more longitudinally aligned openings), but the sets may be oriented in different directions (e.g. angularly offset, for example with phasing). In some embodiments, different sets of aligned adjacent openings 112 may have another opening 112 disposed longitudinally between them, and that other opening 112 may be oriented in a different direction than the sets on either side, as shown in FIG. 7. In some embodiments, the at least one shaped charge is housed in the shaped charge loading tube 104. In some embodiments, a plurality of shaped charges may be housed in the shaped charge loading tube 104, as shown in FIG. 1A.

In some embodiments, the shaped charge loading tube 104 includes at least one of a steel material, a cardboard material, and a plastic material (e.g. injection molded plastic). In the embodiment of FIG. 1A, four shaped charges 105 are housed in the shaped charge loading tube 104 and axially displaced from one another. The firing direction of each shaped charge 105 may be customized depending on the needs of the application. In an aspect and as shown in FIG. 1A, the firing direction of each shaped charge 105 may be radially offset from an adjacent shaped charge 105.

Figure 11:
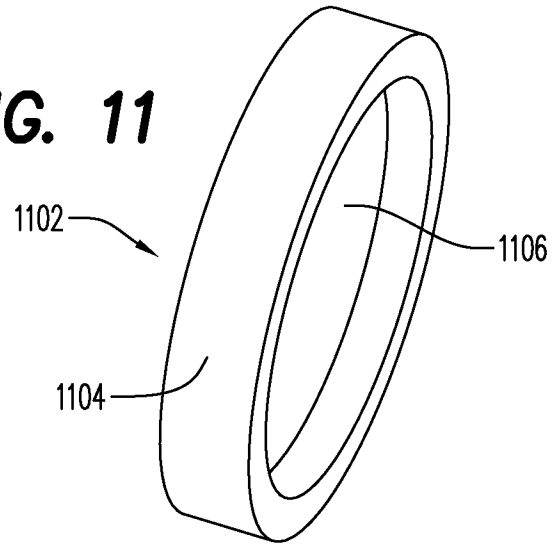
FIG. 11 is a front isometric view of an exemplary bottom end plate, according to an embodiment.
Figure 12:
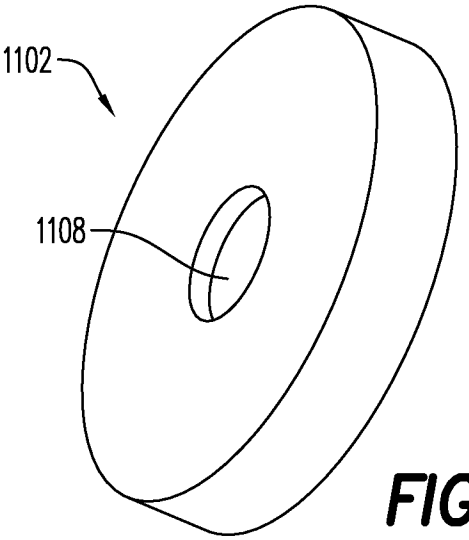
FIG. 12 is a rear isometric view of the bottom end plate of FIG. 11, according to an embodiment.
Figure 10:
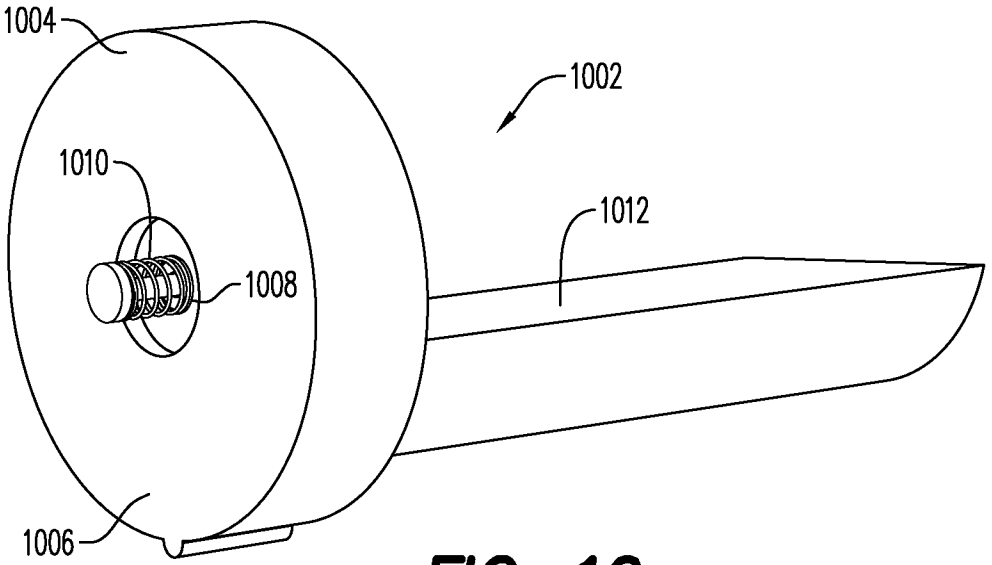
FIG. 10 is a front isometric view of an exemplary top end plate, according to an embodiment.

In some embodiments, the perforating gun assembly 100 may include one or more end plates (see for example, FIGS. 10-12). As seen for example in FIG. 1A and FIGS. 8-9 the perforating gun assembly 100 may include a top end plate 1002 and a bottom end plate 1102. The top end plate 1002 and the bottom end plate 1102 can be positioned on the ends of the shaped charge loading tube 104 (e.g. with the shaped charge loading tube 104 disposed between them). The top end plate 1002 may include a circumferential head portion 1004. An upper surface 1006 of the top end plate 1002 may include an opening 1008 for receiving a spring mechanism 1010. The spring mechanism 1010 may serve as a feed-through. A base wall 1012 may extend from a lower surface of the circumferential head portion 1004. In some embodiments, the base wall 1012 may form a surface for positioning the detonator 109 and a switch 110 assembly. The bottom end plate 1102 may have a lid-like configuration, with a skirt 1004 extending from a base wall 1106. A depression 1108 may be formed on an upper surface of the base wall 1106 of the bottom end plate 1102.

As illustrated in FIG. 1A, the detonating cord 111 can extend from the detonator 109 to ballistically connect the detonator 109 to a base of each shaped charge 105. The detonating cord 111 may be secured in place along the length of the shaped charge loading tube 104 by fasteners 114 (FIGS. 1A, 8) provided on the shaped charge loading tube 104. For example, the fasteners 114 may be disposed on the exterior surface of the shaped charge loading tube 104.

In some embodiments, the shaped charge carrier may include a shaped charge positioning device provided in the gun housing chamber. The shaped charge positioning device may include at least one shaped charge holder and a detonator holder, for example with each of the at least one shaped charge 105 housed in the shaped charge holder. Some embodiments of the shaped charge carrier may include a detonator 109 positioned in the detonator holder. The detonator 109 may be one of a plug and go detonator including an integrated switch and a detonator and switch cartridge assembly.

Figure 13:
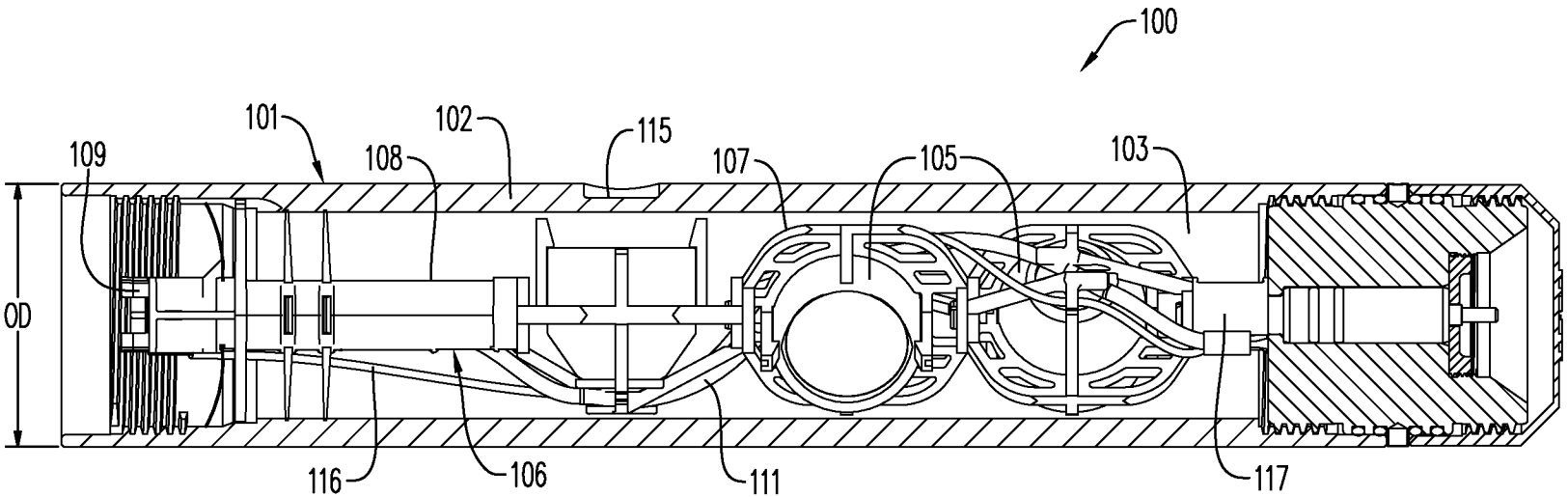
FIG. 13 is a cross-sectional view of an exemplary perforating gun assembly, according to an embodiment.
Figure 14:
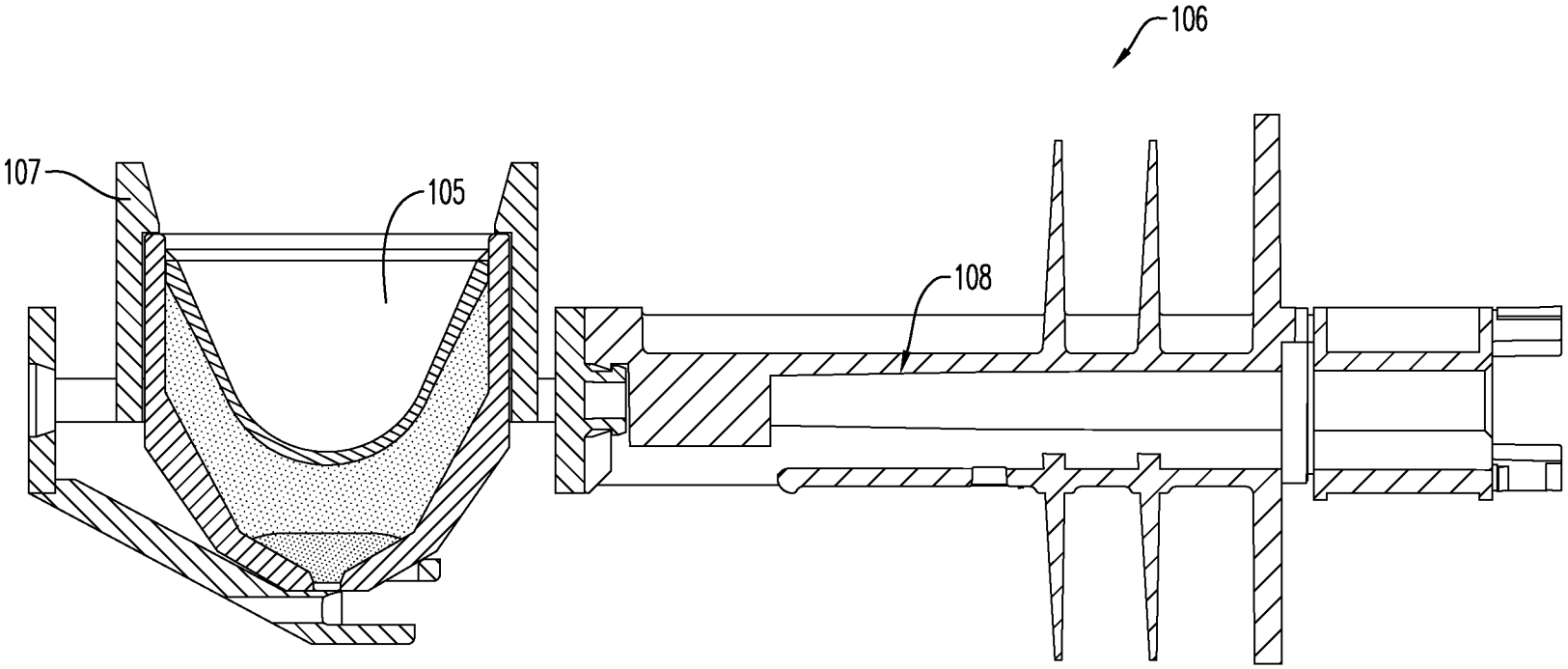
FIG. 14 is cross-section view of a shaped charge holder, according to an embodiment.

For example, and as shown in FIGS. 13-14 the shaped charge carrier may be configured as a shaped charge positioning device 106. In the embodiment of FIG. 14, the shaped charge positioning device 106 can include a single shaped charge holder 107 for receiving a single shaped charge 105. In other embodiments, the shaped charge positioning device 106 may include a plurality of shaped charge holders 107. For example, FIG. 13 illustrates a shaped charge holder 107 configured to position a plurality of shaped charges 105 within the perforating gun housing 101. A detonator holder 108 may be coupled or otherwise secured to the shaped charge positioning device 106. According to an aspect, the detonator holder 108 can extend from the shaped charge positioning device 106. The detonator holder 108 may be configured for securing and positioning a detonator 109 in ballistic communication with the single shaped charge 105 or the plurality of shaped charges 105 (e.g. depending on the embodiment and/or the configuration). In an aspect, the shaped charge positioning device 106 may be a one-piece, monolithic injection molded plastic component comprising the shaped charge holder 107 and detonator holder 108. The detonator 109 may be a plug and go detonator including an integrated switch, a detonator, and a switch cartridge assembly. Alternatively, the detonator 109 may be configured for detonation by an external switch (not shown).

In some embodiments (see, for example, FIG. 13), the shaped charges 105 may be directed to align the open end 113 of the shaped charge 105 towards a reduced wall thickness portion or scallop 115 formed on the outer surface of the gun wall 102. In some embodiments, the scallop 115 may have a reduced wall thickness of about 3 mm to 5 mm. The scallop 115 may be configured to reduce the burr that is typically formed when a shaped charge 105 is detonated through the perforating gun housing 101.

A detonating cord 111 may extend from the detonator 109 along the shaped charge positioning device 106 for ballistic connection to a base of each shaped charge 105. A through-wire 116 may extend from an electrically conductive portion of the detonator 109 to an opposite end of the perforating gun 100 for electrical connection therethrough and to an adjacent perforating gun assembly 100 (e.g. if a plurality of perforating gun assemblies are connected within the tool string). An end connector/detonating cord terminator 117 may be provided at an end of the shaped charge positioning device 106 opposite the detonator holder 108. The end connector/detonating cord terminator 117 may be configured for receiving a terminal end of the detonating cord 111 and a portion of the through-wire 116. The detonating cord terminator 117 may be coupled to a terminal shaped charge holder 107 to aid in positioning and securing the shaped charge positioning device 106 within the gun housing chamber 103.

In some embodiments, the perforating gun assembly 100 may include a plurality of perforating gun assemblies, for example in a tool string. Thus, a tool string may include one or more perforating gun assemblies, for example as described herein. In some embodiments, each perforating gun assembly 100 may typically include the perforating gun housing 101 containing or connected to perforating gun internal components such as: an electrical wire for relaying an electrical control signal such as a detonation signal from the surface to electrical components of the perforating gun; an electrical, mechanical, and/or explosive initiator such as a percussion initiator, an igniter, and/or a detonator 109; a detonating cord 111; one or more shaped charges which may be held in an inner tube, strip, or other carrying device; and other known components including, for example, a booster, a sealing element, a positioning and/or retaining structure, a circuit board, and the like. The internal components may require assembly including connecting electrical components within the perforating gun housing 101 and confirming and maintaining the connections and relationships between internal components. Typical connections may include connecting the electrical relay wire to the detonator 109 or the circuit board, coupling the detonator 109 and the detonating cord 111 and/or the booster, and positioning the detonating cord 111 in a retainer at an initiation point of each charge.

The perforating gun housing 101 may also be connected at each end to a respective adjacent wellbore tool or other component of the tool string such as a firing head and/or a tandem seal adapter or other sub assembly. So in some embodiments, the tool string may include a plurality of tools, (e.g. including one or more perforating gun assembly 100) which may each be generally elongate and/or cylindrical and may connect together at their ends. Connecting the housing to the adjacent component(s) typically may include screwing the perforating gun housing 101 and the adjacent component(s) together via complementary threaded portions of the housing and the adjacent components and forming a connection and seal therebetween. In other embodiments, other types of connectors may be used to connect the perforating gun housing 101 to the adjacent component(s).

As described above, the perforating gun assembly 100 may include shaped charges, typically shaped, hollow, or projectile charges, which are initiated, e.g., by the detonating cord 111, to perforate holes in the casing of the wellbore and to blast through the formation so that the hydrocarbons can flow through the casing. In other operations, the charges may be used for penetrating just the casing, e.g., during abandonment operations that require pumping concrete into the space between the wellbore and the wellbore casing, destroying connections between components, severing a component, and the like. The exemplary embodiments in this disclosure may be applicable to any operation consistent with this disclosure. For purposes of this disclosure, the term "charge" and the phrase "shaped charge" may be used interchangeably and without limitation to a particular type of explosive, shaped charge case, or wellbore operation, unless expressly indicated.

The perforating gun assembly 100 may be utilized in and initial fracturing process or in a refracturing process. Refracturing serves to revive a previously abandoned well in order to optimize the oil and gas reserves that can be obtained from the well. In refracturing processes, a smaller diameter casing is installed and cemented in the previously perforated and accessed well. The perforating gun assembly 100 must fit within the interior diameter of the smaller diameter casing, and the shaped charges 105 installed in the perforating gun must also perforate through double layers of casing and cement combinations in order to access oil and gas reserves.

The shaped charges of the perforating gun assembly 100 may be arranged and secured within the housing by the carrying device which may be, e.g., a typical hollow charge carrier or other holding device that receives and/or engages the shaped charge 105 and maintains an orientation thereof. The carrier (e.g. shaped charge carrier) may be disposed within the perforating gun housing 101 in some embodiments (e.g. a loading tube 104 configured to slide into the perforating gun housing 101), while in other embodiments the perforating gun housing 101 may include, consist essentially of, or form the carrier. In some embodiments, the charges may be arranged in different phasing, such as 60°, 90°, 120°, 180°, 0°-180°, etc. along the length of the charge carrier, so as to form, e.g., a helical pattern along the length of the charge carrier.

Charge phasing generally refers to the radial distribution of charges throughout the perforating gun assembly 100, or, in other words, the angular offset between respective radii along which successive charges in a charge string extend in a direction away from an axis of the charge string. An explosive end of each shaped charge points outwardly along a corresponding radius to fire an explosive jet/perforating jet through the perforating gun housing 101 and wellbore casing, and/or into the surrounding rock formation. Phasing the charges therefore generates perforating jets in a number of different directions and patterns that may be variously desirable for particular applications. On the other hand, it may be beneficial to have each charge fire in the same radial direction. A charge string in which each charge fires in the same radial direction would have zero-degree (0°) phasing. In some embodiments, groups or sets of adjacent shaped charges 105 may be aligned (e.g. with zero-degree phasing for shaped charges 105 within the set), but different groups may be arranged in different phasing. In other embodiments, all shaped charges 105 may be aligned with zero-degree phasing.

In some embodiments, phasing may refer to the angular difference between a shaped charge 105 on a first axial plane and a shaped charge 105 on a second axial plane. For example, when shaped charges 105 are 0-degrees phased, they are in the same plane along the length of a gun so that they are oriented to shoot in the same direction. In another example in which all charges are in a spiral configuration (e.g. 60-degrees phasing), the charges will be oriented to shoot in different directions, at least until the phasings overlap.

In some embodiments, the tool string may include more than one perforating gun assembly 100. Once the one or more perforating gun assembly 100 is properly positioned, a surface signal (e.g. an electrical signal) can actuate an ignition of a fuse or detonator 109, which in turn initiates the detonating cord 111, which detonates the shaped charges to penetrate/perforate the perforating gun housing 101 and wellbore casing, and/or the surrounding rock formation to allow formation fluids to flow through the perforations thus formed and into a production string.

In some embodiments, the perforating gun assembly 100 may be a selective perforating gun assembly 100. By "selective" what is meant in this instance is that the detonator 109 assembly may be configured to receive one or more specific digital sequence(s), which differs from a digital sequence that might be used to arm and/or detonate another detonator 109 assembly in a different (e.g. adjacent) perforating gun assembly 100, for instance, a train of perforating gun assemblies. So, detonation of the various assemblies does not necessarily have to occur in a specified sequence. Any specific assembly can be selectively detonated. In an embodiment, the detonation may occur in a down-up or bottom-up sequence.

In some embodiments, the perforating gun assembly 100 may be configured to be made up as part of the downhole tool string, for example by being connected at one or both ends to other elements or components within the tool string. For example, some embodiments of the perforating gun assembly 100 may further include an orienting ring 119 (as shown for example in FIG. 6). The orienting ring 119 may be configured to attach the perforating gun assembly 100 to another element or component of the tool string and/or to allow for rotational orientation of the perforating gun with respect to the other element/component of the tool string (e.g. allowing orienting the perforating gun assembly 100 relative to adjacent perforating gun assemblies or wellbore string tools connected to the perforating gun assembly 100 to form the tool string). This may allow for the shaped charges 105 in the perforating gun assembly 100 to be oriented as desired. For example, the orienting ring 119 may include (or the perforating gun housing 101 may include) an alignment tandem sub adapter (TSA) in some embodiments, that allows the perforating gun housing 101 to be set in a known fixed angular relationship with an adjacent wellbore tool (e.g. component or element of the tool string). The alignment TSA (e.g. orienting ring 119) can be used, in some embodiments, to fix an adjacent tool string component/element (e.g. such as a second perforating gun assembly 100) relative to the perforating gun assembly 100 so that its shaped charges 105 may be aimed at various pre-set angles.

In some embodiments, an alignment TSA may be configured to be coupled between elements of a tool string and to allow for rotation of adjacent elements of the tool string. In some embodiments, the alignment TSA may also allow for rotational position to be locked, thereby fixing the angular position of the adjacent elements of the tool string with respect to each other. This may allow for alignment of various elements of the tool string according to the specific needs of the project. For example, the alignment TSA may include a first sub body part, a second sub body part, and a lock screw (or other rotational locking element). The first sub body part and the second sub body part may be rotatably coupled to each other, and the first sub body part and the second sub body part may be respectively non-rotatably coupled to a first element of the tool string and a second element of the tool string. The lock screw or other locking element may fix the angular position of the first sub body part and the second sub body part, for example to fix alignment of elements of the tool string. Further description of exemplary embodiments of the alignment TSA may be found in U.S. application Ser. No. 17/206,416 filed Mar. 19, 2021, which is hereby incorporated by reference in its entirety to the extent that it is consistent and/or compatible with this disclosure.

Method embodiments for using perforating gun assemblies, similar to those described herein, are also disclosed. In some embodiments, a method of completing a wellbore (e.g. of an unconventional formation) may include the steps of: positioning the perforating gun assembly in the wellbore at a location having a permeability of less than 10 millidarcy; and using the perforating gun assembly (e.g. discharging or detonating the shaped charges) to form at least one perforation at the location in the wellbore. In some embodiments, the location of the wellbore may have a permeability of less than 1 millidarcy. Some method embodiments may also include providing a perforating gun assembly comprising: a perforating gun housing having an outer diameter of 87-91 mm (e.g. about 3.5 inches); and at least one shaped charge positioned in the perforating gun housing, each of the at least one shaped charge comprising an explosive load having a weight of 28-32 grams or 28-35 grams. In some embodiments, the perforating gun housing may have a wall thickness of about 0.375 inches; the explosive load may include or consist essentially of one of the following: HMX, RDX, PETN, HNS, PYX, and combinations thereof; and/or the perforating gun housing may include or consist essentially of a steel material having one or more of the following properties: minimum steel hardness of 250 HBW or 25 HRC (Rockwell), Minimum Yield Strength of 650 MPa, Minimum Tensile Strength of 900 MPa, and Minimum Impact Strength of 70 Joule.

In some embodiments, the step of positioning the perforating gun assembly in the wellbore may include positioning the perforating gun assembly in a section of the wellbore deviated from a vertical datum (e.g. from vertical) by at least sixty degrees. In some embodiments, the section of the wellbore may be deviated from vertical by at least 70 degrees, at least 80 degrees, 60-80 degrees, or 70-80 degrees, for various embodiments. In some embodiments, after discharge of the shaped charges, the perforating gun housing may have a swell diameter of no more than 96 mm. For example, exemplary method embodiments may include the step of, upon discharge of the shaped charges, expanding (by explosive force of the shaped charge) the outer diameter of the perforating gun housing to a swell diameter of 93-96 mm (e.g. in proximity to the discharged shaped charge and/or at the location along the length of the perforating gun housing where the discharged shaped charge was located). Some exemplary method embodiments may further include removing the perforating gun assembly from the wellbore (e.g. by wireline). Some exemplary method embodiments may further include fracturing the unconventional formation by pumping a fracturing fluid through the at least one perforation (e.g. to fracture a hydrocarbon-bearing unconventional formation).

In some embodiments, the fracturing performance of the unconventional formation may be significantly improved. In some embodiments, using the perforating gun assembly may form a plurality of consistent (e.g. approximately equal) diameter perforation holes (e.g. open areas), whether or not the perforating gun assembly is centered in the wellbore (e.g. even when the perforating gun assembly is not centered in the wellbore).

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A perforating gun assembly, comprising:

a perforating gun housing; and at least one open shaped charge positioned in the perforating gun housing, each open shaped charge of the at least one open shaped charge comprising an explosive load having a weight of 26 grams to 35 grams;

wherein the perforating gun housing comprises a steel material having two or more of the following properties: minimum steel hardness of 250 HBW or 25 HRC(Rockwell), minimum yield strength of 650 MPa, minimum tensile strength of 900 MPa, and minimum impact strength of 70 Joule.

2. The perforating gun assembly of claim 1, wherein each open shaped charge of the at least one shaped charge comprises an explosive load having a weight of 28 grams to 35 grams.

3. The perforating gun assembly of claim 1, wherein the perforating gun housing comprises a wall thickness of about 0.225-0.5625 inches.

4. The perforating gun assembly of claim 3, wherein the perforating gun housing comprises a steel material having three or more of the following properties: a minimum impact strength of 70 Joule, a minimum steel hardness of 250 HBW or 25 HRC(Rockwell), a minimum yield strength of 650 MPa, and a minimum tensile strength of 900 MPa.

5. The perforating gun assembly of claim 1, wherein the explosive load comprises at least one of octahydro-1,3,5,7-tetranitro-1,3,5,7-tetrazocine, cyclotrimethylenetrinitramine, pentaerythritol tetranitrate, hexanitrostibane, and 2,6-Bis(picrylamino)-3,5-dinitropyridine.

6. The perforating gun assembly of claim 1, wherein the perforating gun housing comprises a wall thickness of about 0.3375-0.4125 inches.

7. The perforating gun assembly of claim 1, wherein the perforating gun housing comprises a hollow interior having an inner diameter of about 2.625 inches to 2.9 inches, and wherein the at least one open shaped charge is configured to be disposed within the hollow interior.

8. The perforating gun assembly of claim 1, wherein the at least one open shaped charge comprises a plurality of open shaped charges; and wherein the plurality of open shaped charges are all substantially identical.

9. The perforating gun assembly of claim 8, wherein:

the plurality of open shaped charges are oriented to fire outward at different radial locations around a circumference of the perforating gun housing to create perforation holes in a target; and each perforation hole of the perforation holes includes an open area that is open to flow of wellbore fluid and has a size that is substantially constant between both centralized and decentralized conditions of the perforating gun housing in a casing of the wellbore.

10. The perforating gun assembly of claim 1, wherein the perforating gun housing is configured so that, upon discharge of the at least one open shaped charge, the outer diameter of the perforating gun housing expands to a swell diameter, and the swell diameter is greater than an initial outer diameter of the perforating gun housing but less than 3.78 inches.

11. A perforating gun assembly, comprising:

a perforating gun housing comprising steel; and at least one open-ended shaped charge positioned in the perforating gun housing, the at least one open-ended shaped charge comprising an explosive load having a weight of 28 grams to 35 grams, wherein the perforating gun housing is configured so that, upon discharge of the at least one open-ended shaped charge, an outer diameter of the perforating gun housing expands to a swell diameter, and the swell diameter is no more than 3.78 inches; and wherein the open-ended shaped charge is configured to form a perforation tunnel in a low permeability rock formation having a permeability of 10 millidarcy or less.

12. The perforating gun assembly of claim 11, wherein the open-ended shaped charge is configured to form the perforation tunnel in a low permeability rock formation having a permeability of less than 1 millidarcy.

13. The perforating gun of assembly claim 11, wherein the open-ended shaped charge is configured to form the perforation tunnel with a perforation hole diameter of 0.30 inches to 0.85 inches in a steel casing of a wellbore.

14. The perforating gun assembly of claim 11, wherein:

the perforating gun housing comprises steel having two or more of the following properties: minimum steel hardness of 250 HBW or 25 HRC(Rockwell), minimum yield strength of 650 MPa, minimum tensile strength of 900 Mpa, and minimum impact strength of 70 Joule.

15. The perforating gun assembly of claim 11, wherein:

the at least one open-ended shaped charge comprises a plurality of open-ended shaped charges;

the plurality of open-ended shaped charges are oriented to fire outward at different radial locations around a circumference of the perforating gun housing to create perforation holes in a target; and each perforation hole of the perforation holes includes an open area that is open to flow of wellbore fluid and has a size that is substantially constant between both centralized and decentralized conditions of the perforating gun housing in a casing of the wellbore.

16. The perforating gun assembly of claim 15, wherein the perforating gun assembly includes a shot density of 2 to 6 shots per foot.

17. A method of completing a wellbore, the method comprising the steps of:

positioning a perforating gun assembly in a section of a wellbore deviated from a vertical datum by 70-90 degrees and having a permeability of less than ten millidarcy, wherein the perforating gun assembly comprises:

a perforating gun housing comprising a steel material having two or more of the following properties: minimum steel hardness of 250 HBW or 25 HRC (Rockwell), minimum yield strength of 650 MPa, minimum tensile strength of 900 MPa, and minimum impact strength of 70 Joule; and an open shaped charge positioned in the perforating gun housing, the open shaped charge comprising an explosive load having a weight of 26 grams to 35 grams;

detonating the shaped charge to form a perforation in the wellbore; and pumping a fracturing fluid through the perforation to fracture a hydrocarbon-bearing formation.

18. The method of claim 17, wherein positioning the perforating gun assembly in the wellbore comprises: using a wireline to position the perforating gun assembly in the wellbore.

19. The method of claim 17, wherein upon detonating the shaped charge, the method further comprises:

expanding an outer diameter of the perforating gun housing to a swell diameter of up to 3.78 inches by an explosive force generated by the shaped charge.

20. The method of claim 17, wherein positioning a perforating gun assembly comprises positioning a perforating gun assembly in a section of a wellbore deviated from a vertical datum by 70-80 degrees; and wherein detonating the shaped charge forms the perforation with a perforation hole diameter of about 0.30 inches to about 0.85 inches in the wellbore.

* * * * *